US010043344B2

(12) United States Patent
Arnone et al.

(10) Patent No.: US 10,043,344 B2
(45) **Date of Patent: *Aug. 7, 2018**

(54) ALTERNATIVE APPLICATION RESOURCE INTERLEAVED WAGERING SYSTEM

(71) Applicant: Gamblit Gaming, LLC, Glendale, CA (US)

(72) Inventors: Miles Arnone, Sherborn, MA (US); David Chang, San Gabriel, CA (US); Frank Cire, Pasadena, CA (US); Eric Meyerhofer, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/687,922

(22) Filed: Aug. 28, 2017

(65) Prior Publication Data

US 2017/0358174 A1 Dec. 14, 2017

Related U.S. Application Data

(63) Continuation of application No. 14/686,678, filed on Apr. 14, 2015, now Pat. No. 9,747,747.

(60) Provisional application No. 61/980,008, filed on Apr. 15, 2014.

(51) Int. Cl.
*G07F 17/32* (2006.01)

(52) U.S. Cl.
CPC ..... *G07F 17/3244* (2013.01); *G07F 17/323* (2013.01); *G07F 17/3241* (2013.01)

(58) Field of Classification Search
USPC ..... 463/25
See application file for complete search history.

(56) References Cited

U.S. PATENT DOCUMENTS

| | | | |
|---|---|---|---|
| 5,413,357 | A | 5/1995 | Schulze et al. |
| 5,718,429 | A | 2/1998 | Keller |
| 5,785,592 | A | 7/1998 | Jacobsen |
| 5,853,324 | A | 12/1998 | Kami et al. |
| 5,963,745 | A | 10/1999 | Collins et al. |
| 6,050,895 | A | 4/2000 | Luciano |
| 6,165,071 | A | 12/2000 | Weiss |
| 6,227,974 | B1 | 5/2001 | Eilat |

(Continued)

OTHER PUBLICATIONS

U.S. Appl. No. 15/362,660 Arnone, et al. filed Nov. 28, 2016.

(Continued)

*Primary Examiner* — Pierre E Elisca
(74) *Attorney, Agent, or Firm* — Caitlyn Ross

(57) ABSTRACT

An electronic gaming machine including a wager controller constructed to: receive application telemetry; determine a wager request; determine a encrypted wager outcome; communicate encrypted wager outcome data; an application server controller constructed to: receive decrypted wager outcome instructions; determine application resources to award the application client controller; and communicate application resource data to the application client controller; and the application client controller operatively connecting the application server controller and the wager controller, the application client controller constructed to: receive encrypted wager outcome data; decrypted the encrypted wager outcome data communicate the decrypted wager outcome instructions.

17 Claims, 14 Drawing Sheets

(56) References Cited

U.S. PATENT DOCUMENTS 6,267,669 B1 7/2001 Luciano
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Amone
8,480,470 B2 7/2013 Napolitano et al.
8,622,809 B1 1/2014 Arora et al.
8,864,564 B2 10/2014 Oberberger
9,070,257 B1 6/2015 Scalise
9,607,477 B2 * 3/2017 Gagner ..... G07F 17/3267
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.

(56) References Cited

U.S. PATENT DOCUMENTS

2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0285869 A1 11/2010 Walker
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0070945 A1 3/2011 Walker
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1 12/2012 Amone et al.
2013/0029760 A1 1/2013 Wickett
2013/0130779 A1* 5/2013 Gagner ..... G07F 17/3267 463/25
2013/0131848 A1 5/2013 Amone et al.
2013/0190074 A1 7/2013 Amone et al.
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.
2014/0357350 A1 12/2014 Weingardt
2016/0042599 A1* 2/2016 Toohey ..... G07F 17/3225 463/25

OTHER PUBLICATIONS

U.S. Appl. No. 15/365,628 Arnone, et al. filed Nov. 30, 2016.
U.S. Appl. No. 15/367,541 Arnone, et al. filed Dec. 2, 2016.
U.S. Appl. No. 15/369,394 Arnone, et al. filed Dec. 5, 2016.
U.S. Appl. No. 15/370,425 Arnone, et al. filed Dec. 6, 2016.
U.S. Appl. No. 15/375,711 Arnone, et al. filed Dec. 12, 2016.
U.S. Appl. No. 15/387,117 Arnone, et al. filed Dec. 21, 2016.
U.S. Appl. No. 15/392,887 Arnone, et al. filed Dec. 28, 2016.
U.S. Appl. No. 15/393,212 Arnone, et al. filed Dec. 28, 2016.
U.S. Appl. No. 15/394,257 Arnone, et al. filed Dec. 29, 2016.
U.S. Appl. No. 15/396,352 Arnone, et al. filed Dec. 30, 2016.
U.S. Appl. No. 15/396,354 Arnone, et al. filed Dec. 30, 2016.
U.S. Appl. No. 15/396,365 Arnone, et al. filed Dec. 30, 2016.
U.S. Appl. No. 15/406,474 Arnone, et al. filed Jan. 13, 2017.
U.S. Appl. No. 15/413,322 Arnone, et al. filed Jan. 23, 2017.
U.S. Appl. No. 15/415,833 Arnone, et al. filed Jan. 25, 2017.
U.S. Appl. No. 15/417,030 Arnone, et al. filed Jan. 26, 2017.
U.S. Appl. No. 15/422,453 Arnone, et al. filed Feb. 1, 2017.
U.S. Appl. No. 15/431,631 Arnone, et al. filed Feb. 13, 2017.
U.S. Appl. No. 15/434,843 Arnone, et al. filed Feb. 16, 2017.
U.S. Appl. No. 15/439,499 Arnone, et al. filed Feb. 22, 2017.
U.S. Appl. No. 15/449,249 Arnone, et al. filed Mar. 3, 2017.
U.S. Appl. No. 15/449,256 Arnone, et al. filed Mar. 3, 2017.
U.S. Appl. No. 15/450,287 Arnone, et al. filed Mar. 6, 2017.
U.S. Appl. No. 15/456,079 Arnone, et al. filed Mar. 10, 2017.
U.S. Appl. No. 15/457,827 Arnone, et al. filed Mar. 13, 2017.
U.S. Appl. No. 15/458,490 Arnone, et al. filed Mar. 14, 2017.
U.S. Appl. No. 15/460,195 Arnone, et al. filed Mar. 15, 2017.
U.S. Appl. No. 15/463,725 Arnone, et al. filed Mar. 20, 2017.
U.S. Appl. No. 15/464,282 Arnone, et al. filed Mar. 20, 2017.
U.S. Appl. No. 15/465,521 Arnone, et al. filed Mar. 21, 2017.
U.S. Appl. No. 15/470,869 Arnone, et al. filed Mar. 27, 2017.
U.S. Appl. No. 15/473,523 Arnone, et al. filed Mar. 29, 2017.
U.S. Appl. No. 15/483,773 Arnone, et al. filed Apr. 10, 2017.
U.S. Appl. No. 15/489,343 Arnone, et al. filed Apr. 17, 2017.
U.S. Appl. No. 15/491,617 Arnone, et al. filed Apr. 19, 2017.
U.S. Appl. No. 15/583,295 Arnone, et al. filed May 1, 2017, 2017.
U.S. Appl. No. 15/589,780 Arnone, et al. filed May 8, 2017.
U.S. Appl. No. 15/597,123 Arnone, et al. filed May 16, 2017.
U.S. Appl. No. 15/597,812 Arnone, et al. filed May 17, 2017.
U.S. Appl. No. 15/599,590 Arnone, et al. filed May 19, 2017.
U.S. Appl. No. 15/605,688 Arnone, et al. filed May 25, 2017.
U.S. Appl. No. 15/605,705 Arnone, et al. filed May 25, 2017.
U.S. Appl. No. 15/626,754 Arnone, et al. filed Jun. 19, 2017.
U.S. Appl. No. 15/631,762 Arnone, et al. filed Jun. 23, 2017.
U.S. Appl. No. 15/632,478 Arnone, et al. filed Jun. 26, 2017.
U.S. Appl. No. 15/632,479 Arnone, et al. filed Jun. 26, 2017.
U.S. Appl. No. 15/632,943 Arnone, et al. filed Jun. 26, 2017.
U.S. Appl. No. 15/632,950 Arnone, et al. filed Jun. 26, 2017.
U.S. Appl. No. 15/641,119 Arnone, et al. filed Jul. 3, 2017.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.

(56) References Cited

OTHER PUBLICATIONS

U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
U.S. Appl. No. 15/651,934 Arnone, et al. filed Jul. 17, 2017.
U.S. Appl. No. 15/657,826 Arnone, et al. filed Jul. 24, 2017.
U.S. Appl. No. 15/657,835 Arnone, et al. filed Jul. 24, 2017.
U.S. Appl. No. 15/664,535 Arnone, et al. filed Jul. 31, 2017.
U.S. Appl. No. 15/667,168 Arnone, et al. filed Aug. 2, 2017.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.

(56) References Cited

OTHER PUBLICATIONS

U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2011.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 15/280,255 Arnone, et al. filed Sep. 29, 2016.
U.S. Appl. No. 15/286,922 Arnone, et al. filed Oct. 6, 2016.
U.S. Appl. No. 15/287,129 Arnone, et al. filed Oct. 6, 2016.
U.S. Appl. No. 15/289,648 Arnone, et al. filed Oct. 10, 2016.
U.S. Appl. No. 15/297,019 Arnone, et al. filed Oct. 18, 2016.
U.S. Appl. No. 15/298,533 Arnone, et al. filed Oct. 20, 2016.
U.S. Appl. No. 15/336,696 Arnone, et al. filed Oct. 27, 2016.
U.S. Appl. No. 15/339,898 Arnone, et al. filed Oct. 31, 2016.
U.S. Appl. No. 15/345,451 Arnone, et al. filed Nov. 7, 2016.
U.S. Appl. No. 15/362,214 Arnone, et al. filed Nov. 28, 2016.

* cited by examiner

ALTERNATIVE APPLICATION RESOURCE INTERLEAVED WAGERING SYSTEM

CROSS REFERENCE TO RELATED APPLICATIONS

This application is a continuation of U.S. patent application Ser. No. 14/686,678, filed Apr. 14, 2015, which claims priority to and the benefit of U.S. Provisional Patent Application No. 61/980,008, filed Apr. 15, 2014, the disclosure of which is incorporated by reference herein in its entirety.

FIELD OF THE INVENTION

Embodiments of the present invention are generally related to gaming and more specifically to an alternative application resource interleaved wagering system.

BACKGROUND

The gaming machine manufacturing industry has traditionally developed gaming machines with a wagering game. A wagering game is typically a game of chance, which is a game where the outcome of the game is generally dependent solely on chance (such as a slot machine). A game of chance can be contrasted with a game of skill where the outcome of the game can depend upon a user's skill with the game. Wagering games are typically not as interactive and do not include graphics as sophisticated as an interactive application, which is a game of skill such as a video game.

SUMMARY OF THE INVENTION

Systems and methods in accordance with embodiments of the invention provide an electronic gaming machine.

One embodiment includes: a wager controller constructed to: receive, from an application client controller, application telemetry; scan the application telemetry to determine a wager request; determine an encrypted wager outcome based on the wager request; and communicate, to the application client controller, the encrypted wager outcome that is encrypted with a private encryption key of the wager controller; provide, to the application client controller, a public key for decrypting the encrypted wager outcome; and an application server controller constructed to: receive, from the application client controller, decrypted wager outcome instructions; determine application resources to award the application client controller based on the decrypted wager outcome; and communicate application resource data to the application client controller, the application resource data based on the determined application resources; and the application client controller operatively connecting the application server controller and the wager controller, the application client controller constructed to: communicate, to the wager controller, the application telemetry, wherein the application telemetry is associated with an interactive application provided by the application client controller; receive, from the wager controller, the encrypted wager outcome; decrypt the encrypted wager outcome by using the public key; generate the decrypted wager outcome instructions based on the encrypted wager outcome; instruct the application server controller by communicating the decrypted wager outcome instructions; receive, from the application server controller, the application resource data; scan the application resource data to determine the application resources awarded based on the decrypted wager outcome; and display the decrypted wager outcome and the application resources awarded.

In a further embodiment, the application client controller and the application server controller are constructed from the same device, and the application client controller is operatively connected to the wager controller using a communication link.

In a further embodiment, the wager controller and the application client controller are constructed from the same device, and the application client controller is operatively connected to the application server controller using a communication link.

In a further embodiment, the wagering controller is included in a wagering server device, the application server controller is included in an application server device, and the application client controller is included in an application client device, the application client device being external to the wagering server device and the application server device, the application client device is communicatively coupled to the wagering server device and the application server device.

In a further embodiment, the application client controller comprises a client application control layer module, and the application client controller is operatively connected to the application client controller and the wager controller via the client application control layer module, and the application server controller comprises a server application control layer module, and the application server controller is operatively connected to the application client controller via the server application control layer module.

In a further embodiment, the wagering controller is included in a wagering server device, the application server controller and the server application control layer module are included in an application server device, and the application client controller and the client application control layer module are included in an application client device, the application client device is external to the wagering server device and the application server device, and the application client device is communicatively coupled to the interactive application server device and the wagering server device.

In a further embodiment, the server application control layer module is constructed to provide communication between the wagering controller and the application server controller by using a first communication channel, and the server application control layer module is constructed to provide communication between the wagering controller and the application client device by using a second communication channel, the second communication channel being an encrypted communication channel.

An embodiment includes an application server controller constructed to: receive, from the application client controller, decrypted wager outcome instructions; determine application resources to award the application client controller based on the decrypted wager outcome; and communicate application resource data to the application client controller, the application resource data based on the determined application resources; and the application client controller operatively connecting the application server controller and a wager controller, the application client controller constructed to: communicate, to the wager controller, application telemetry, wherein the application telemetry is associated with an interactive application provided by the application client controller; receive, from the wager controller, encrypted wager outcome data; receive, from the wager controller, a public key; decrypt the encrypted wager outcome by using the public key; generate the decrypted wager outcome instructions based on the encrypted wager outcome; instruct the application server controller by communicating the decrypted wager outcome instructions; receive, from the application server controller, the application resource data; scan the application resource data to determine the application resources awarded based on the decrypted wager outcome; and display the decrypted wager outcome and the application resources awarded.

An embodiment includes a wager controller constructed to: receive, from an application client controller, application telemetry; scan the application telemetry to determine a wager request; determine an encrypted wager outcome based on the wager request; and communicate, to the application client controller, the encrypted wager outcome that is encrypted with a private encryption key of the wager controller; provide, to the application client controller, a public key for decrypting the encrypted wager outcome; and the application client controller operatively connecting an application server controller and the wager controller, the application client controller constructed to: communicate, to the wager controller, the application telemetry, wherein the application telemetry is associated with an interactive application provided by the application client controller; receive, from the wager controller, the encrypted wager outcome data; decrypt the encrypted wager outcome by using the public key; generate the decrypted wager outcome instructions based on the encrypted wager outcome; instruct the application server controller by communicating the decrypted wager outcome instructions; receive, from the application server controller, the application resource data; scan the application resource data to determine the application resources awarded based on the decrypted wager outcome; and display the decrypted wager outcome and the application resources awarded.

DETAILED DESCRIPTION

Figure 1:
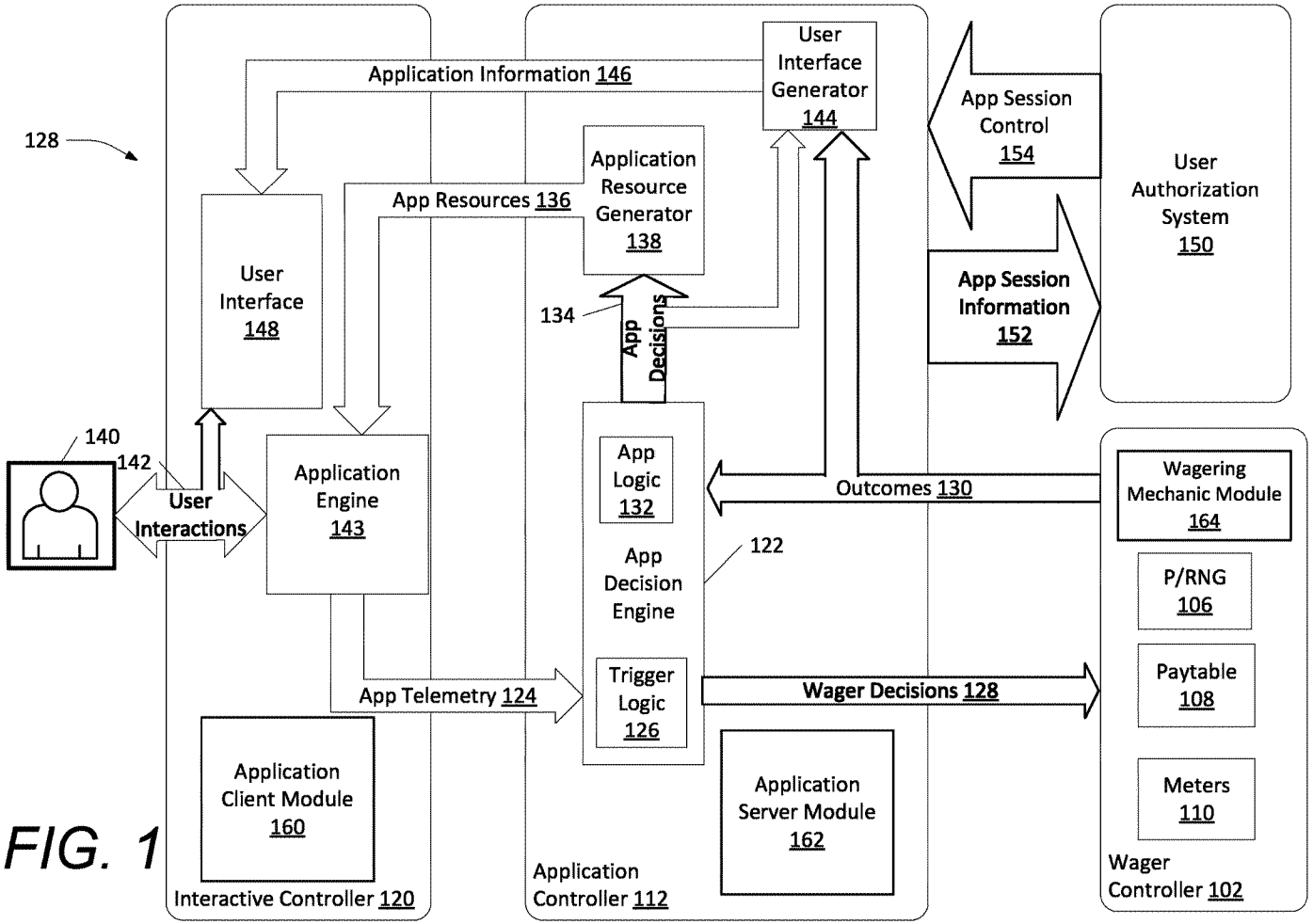
FIG. 1 illustrates an alternative application resource interleaved wagering system in accordance with an embodiment of the invention.

Turning now to the drawings, systems and methods for operation of an alternative application resource interleaved wagering system are illustrated. In several embodiments, an alternative application resource interleaved wagering system is a form of a combined skill and wagering mechanic that integrates both a wagering mechanic that includes a wager controller which manages the wagering mechanic, as well as a skill-based interactive application provided by an interactive controller coupled to the wager controller by an application controller which manages the configuration of the alternative application resource interleaved wagering system interactive controller. The interactive controller executes the skill-based components of the alternative application resource interleaved wagering system interactive application for user entertainment. In certain embodiments, the alternative application resource interleaved wagering system also includes a user interface associated with either or both the wagering mechanic and the interactive application. A user of an alternative application resource interleaved wagering system is the electronic representation of interactions, typically via a user interface, and associated with a user profile of the alternative application resource interleaved wagering system. In operation of an alternative application resource interleaved wagering system, a user acts upon various types of elements of the interactive application in an interactive application environment.

In many embodiments, elements are a limited resource consumed within an interactive application to advance interactive application interaction. In playing the interactive application using the elements, a user can (optionally) consume and accrue application credits (AC) within the interactive application. These credits can be in the form of (but are not limited to) application credits, experience points, or points generally. Wagers can be made in the wagering mechanic as triggered by the user's use of one or more elements of the interactive application. The wagers are made using real world credits (RC). The real world credits can be credits in an actual currency, or can be credits in a virtual currency which has real world value. Wagering outcomes from the wagering mechanic can cause consumption, loss or accrual of RC. In addition, wagering outcomes in the wagering mechanic can influence elements in the interactive application such as (but not limited to) by restoring a consumed element, causing the loss of an element, restoration or placement of a fixed element. In certain embodiments, wagering mechanics can facilitate the wager of AC for a randomly generated payout of AC or a wager of elements for a randomly generated payout of elements. In particular embodiments, an amount of AC and/or elements used as part of a wager can have a RC value if cashed out of an alternative application resource interleaved wagering system session.

Example elements include enabling elements (EE) which are elements that enable a user's play of the interactive application and whose consumption by the user while playing the interactive application can trigger a wager in a wagering mechanic. Another non limiting example of an element is a reserve enabling element (REE), which is an element that converts into one or more enabling elements upon occurrence of a release event in interleaved wagering system interaction. Other types of elements include actionable elements (AE) which are elements that are acted upon to trigger a wager in the wagering mechanic and may or may not be restorable during normal play of the interactive application. Another type of element is a common enabling element (CEE) which as an element that may be shared by two or more users and the use of which by any of the users causes a wager to be triggered.

In an embodiment when the interactive application is an interactive game, in progressing through an interactive application session, elements can be utilized by a user during interactions with a controlled entity (CE) which is a character, entity, inanimate object, device or other object under control of a user.

Also, interactive application progress and wager triggers can be dependent upon an interactive application variable such as, but not limited to: a required game object (RGO) which is a specific game object in an interactive application acted upon for an AE to be completed (such as but not limited to a specific key needed to open a door); a required environmental condition (REC) which is a game state present within an interactive application for an AE to be completed (such as but not limited to daylight whose presence enables a character to walk through woods); or a controlled entity characteristic (CEC) which is a status of the CE within an interactive application for an AE to be completed (such as but not limited to a CE to have full health points before entering battle). Although various application resources, such as but not limited to AC, RC and elements as discussed above, any application resource can be utilized to advance alternative application resource interleaved wagering system interactions as well as form the basis for a trigger of a wager as appropriate to the specification of a specific application in accordance with various embodiments of the invention.

In many embodiments, an alternative application resource interleaved wagering system integrates an interactive application with a wagering mechanic. In several embodiments, an alternative application resource interleaved wagering system can utilize an application controller to monitor alternative application resource interleaved wagering system interactive application session executed by an interactive controller for a wagering event occurrence. The wagering event occurrence can be detected from the skillful execution of the alternative application resource interleaved wagering system interactive application in accordance with at least one wagering event occurrence rule. The wagering event occurrence can be communicated to a wager controller, where the wagering event occurrence triggers a RC wager made in accordance with a wager trigger rule within the wagering mechanic executed by the wager controller. The wager can produce a wager payout as a randomly generated payout of both RC and application resources. In addition, an alternative application resource interleaved wagering system interactive application session modification can be generated by the application controller that can be used to modify interactive application session executed by the interactive controller based upon the wager payout. In various embodiments, alternative application resource interleaved wagering system interactive application session can advance through the performance of alternative application resource interleaved wagering system user actions, where an alternative application resource interleaved wagering system user action is an action during alternative application resource interleaved wagering system session that can be performed by a user or to a user.

In several embodiments, a wagering event occurrence can be determined from one or more application variables within an alternative application resource interleaved wagering system interactive application that are used to trigger a wager in a wagering mechanic. Application variables can include, but are not limited to, passage of a period of time during alternative application resource interleaved wagering system interactive application interaction, a result from an alternative application resource interleaved wagering system interactive application session (such as but not limited to achieving a goal or a particular score), a user action that is a consumption of an element, or a user action that achieves a combination of elements to be associated with a user profile.

In numerous embodiments, an interactive application modification is an instruction of how to modify alternative application resource interleaved wagering system interactive application resources based upon one or more of a wager outcome and application variables. An interactive application modification can modify any aspect of an alternative application resource interleaved wagering system interactive application, such as but is not limited to an addition of a period of time available for a current alternative application resource interleaved wagering system interactive application session, an addition of a period of time available for a future alternative application resource interleaved wagering system interactive application session or any other modification to elements that can be utilized in alternative application resource interleaved wagering system interactive application session. In certain embodiments, an interactive application modification can modify a type of element whose consumption triggers a wagering event occurrence. In particular embodiments, an interactive application modification can modify a type of element whose consumption is not required in a wagering event occurrence.

In a number of embodiments, a user interface can be utilized that depicts a status of the alternative application resource interleaved wagering system interactive application. A user interface can depict any aspect of an alternative application resource interleaved wagering system interactive application including, but not limited to, an illustration of alternative application resource interleaved wagering system interactive application advancement as a user interacts with the alternative application resource interleaved wagering system.

In some embodiments, a user authorization system 150 is used to authorize an interleaved wagering system session. The user authorization system receives application session information 152, that may include, but is not limited to, user, interactive controller, application controller and wager controller information from the application controller 112. The user authorization system uses the user, interactive controller, application controller and wager controller information to regulate an interleaved wagering system session. In some embodiments, the user authorization system may also assert control of an interactive application session 154. Such control may include, but is not limited to, ending an interactive application session, initiating wagering in an interactive application session, ending wagering in an interactive application session but not ending a user's play of the interactive application portion of the interactive application, and changing from real credit wagering to virtual credit wagering, or vice versa.

Alternative Application Resource Interleaved Wagering System

In many embodiments, an alternative application resource interleaved wagering system integrates high-levels of entertainment content with a game of skill (alternative application resource interleaved wagering system interactive application) and a wagering experience with a game of chance (wagering game). An alternative application resource interleaved wagering system provides for random wagering outcomes independent of user skill while providing that the user's gaming experience (as measured by obstacles/challenges encountered, time of play and other factors) is shaped by the user's skill. An alternative application resource interleaved wagering system in accordance with an embodiment of the invention is illustrated in FIG. 1. The alternative application resource interleaved wagering system 128 includes a wager controller 102, and an application controller 112. The wager controller 102 is connected with the application controller. The interactive controller 120 is also connected with the application controller 112. In some embodiments, the connection between the wager controller 102 and the application controller 112 and the connection between the interactive controller 120 and the application controller 112 is a network connection.

In many embodiments, the interactive controller includes an interactive application client module 160 that implements one or more features of an alternative application resource interleaved wagering system as described herein.

In several embodiments, the wager controller 102 is the operating system for the wagering mechanic of the alternative application resource interleaved wagering system 128 and controls and operates the wagering mechanic. The operation of a wagering mechanic is enabled by RC, such as money or other real world funds. A wagering mechanic can increase or decrease an amount of RC based on random wagering outcomes, where the wagering proposition of a wagering mechanic is typically regulated by gaming control bodies. In many embodiments, the wager controller includes a pseudo random or random number generator (P/RNG) 106, one or more real-world credit pay tables 108, RC meters 110 and other software constructs that enable a wagering mechanic to offer a fair and transparent wagering proposition, and the auditable systems and functions that can enable the wagering mechanic to obtain gaming regulatory body approval.

P/RNG 106 includes software and/or hardware and/or processes, which are used to generate random or pseudo random outcomes. The one or more pay tables 108 are tables that can be used in conjunction with P/RNG 106 to determine an amount of real world credits (RC) earned as a function of alternative application resource interleaved wagering system interaction and are analogous to the pay tables used in a conventional slot machine. There can be one or a plurality of table pay tables 108 in the wager controller and used to implement one or more wagering mechanics, the selection of which can be determined by factors including (but not limited to) game progress a user has earned, and/or bonus rounds which a user can be eligible for. Real world credits (RC) are credits analogous to slot machine game credits, which are entered into an interleaved wagering system by the user, either in the form of money such as hard currency or electronic funds. RCs can be decremented or augmented based on the outcome of the P/RNG 106 according to the pay table pay table 108, independent of user skill. In certain embodiments, an amount of RC can be used as criteria in order to enter higher alternative application resource interleaved wagering system interactive application levels. RC can be carried forward to higher game levels or paid out if a cash out is opted for by a user. The amount of RC used to enter a specific level of the game level n need not be the same for each level.

In many embodiments, the wager controller includes a wagering mechanic module 164 that implements one or more features of an alternative application resource interleaved wagering system as described herein.

In many embodiments, the application controller 112 manages the overall alternative application resource interleaved wagering system operation, with the wager controller 102 and the interactive controller 120 being support units to the application controller 112. In several embodiments, the application controller 112 may include mechanical, electronic and software system for an alternative application resource interleaved wagering system interactive application. The application controller 112 provides an interface between alternative application resource interleaved wagering system interactive application 120 and the alternative application resource interleaved wagering system wagering mechanic 102. The application controller includes an interactive application decision engine 122 that receives application telemetry 124 from the interactive controller 120. The interactive application decision engine uses the application telemetry, along with trigger logic 126 to make wagering decisions 128 about triggering a wager of RC in the wager controller 102. The application telemetry data may include, but is not limited to, interactive application information, wager requests, application variables from the interactive controller that indicate the state of the interactive controller and the interactive application that is being played by a user 140 and user actions and interactions 142 between the user and an application engine 143 of the interactive controller. The wager information may include, but is not limited to, an amount of RC to be wagered, a trigger of a wagering mechanic and a selection of a paytable to be used by the wagering mechanic.

In some embodiments, the interactive application decision engine also receives wagering outcomes 130 from the wager controller. The decision engine uses the wagering outcomes, in conjunction with a the application telemetry 124 and interactive application logic 132 to make interactive application decisions 134 about what kind of interactive application resources 136 are to be provided to the interactive controller 120. An interactive application resource generator 138 generates the interactive application resources based on the interactive application decisions made by the interactive application decision engine and transmits them to the interactive controller 120.

In various embodiments, the interactive application decision engine also calculates how much AC to award to the user 140 based at least in part on the user's skillful execution of the interactive application of the alternative application resource interleaved wagering system as determined from the application telemetry 124. In some embodiments, wagering outcomes 130 are also used to determine how much AC should be awarded to the user.

In some embodiments, the interactive application decisions 134 and wagering outcomes 130 are provided to a user interface generator 144. The user interface generator receives the interactive application decisions and wagering outcomes and generates alternative application resource interleaved wagering system information describing the state of the alternative application resource interleaved wagering system. The alternative application resource interleaved wagering system information includes, but is not limited to, amounts of AC amounts earned, lost or accumulated by the user through skillful execution of the interactive application and RC amounts won, lost or accumulated as determined from the wagering outcomes 130 and the RC meters 110.

The application controller 112 can further couple to the wager controller 102 to determine the amount of RC available on the application and other metrics of wagering on the wagering mechanic (and potentially affect the amount of RC in play on the wager controller). The application controller additionally may include various audit logs and activity meters. In some embodiments, the application controller 112 can also couple to a centralized server for exchanging various data related to the user and their activities on the application. The application controller 112 furthermore couples to the interactive controller 120.

In several embodiments, interactive application credits (AC) are user points earned or depleted as a function of user skill, specifically as a function of user performance in the context of the application. AC may be analogous to the score in a typical video game. An alternative application resource interleaved wagering system interactive application can have one or more scoring criteria, embedded within the application controller 112 or the interactive controller 120 that reflect user performance against the goal(s) of the alternative application resource interleaved wagering system interactive application. In some embodiments, AC can be carried forward from one level of sponsored application interaction to another. In many embodiments, AC can be used within the interactive controller to purchase in application items, including but not limited to, elements that have particular properties, power ups or the like. In other embodiments, AC may be used to earn entrance into a sweepstakes drawing, or earning participation in, or victory in, a tournament with prizes. In many embodiments, AC can be stored on a user tracking card or in a network-based user tracking system, where the AC is attributed to a specific user.

In certain embodiments, the operation of the application controller does not affect the wager controller's wagering operation except for user choice parameters that are allowable in slot machines including but not limited to wager terms such as but not limited to a wager amount, how fast the user wants to play (by pressing a button or pulling the handle of a slot machine) and/or agreement to wager into a bonus round. In this sense, the wager controller 102 provides a fair and transparent, non-skill based wagering proposition co-processor to the application controller 112. In the illustrated embodiment, the transfer of application telemetry 124 shown between the application controller 112 and the wager controller 102 allow the application controller 112 to obtain information from the wager controller 102 as to the amount of RC available in the wagering mechanic. In various embodiments, the communication links can also convey a status operation of the wager controller (such as on-line or tilt). In numerous embodiments the communication links can further communicate the various wagering control factors which the wager controller 102 uses as input, such as the number of RC consumed per game or the user's election to enter a jackpot round. In FIG. 1, the application controller 112 is also shown as connecting to the user's user interface directly, as this can be utilized to communicate certain alternative application resource interleaved wagering system interactive application club points, user status, control the selection of choices and messages which a user can find useful in order to adjust the an alternative application resource interleaved wagering system interactive application experience or understand their wagering status in the wager controller 102.

In many embodiments, the application controller includes an interactive application server module 162 that implements one or more features of an alternative application resource interleaved wagering system as described herein.

In various embodiments, the interactive controller 120 manages and controls the visual, audio, and user control for the alternative application resource interleaved wagering system interactive application. In certain embodiments, the interactive controller 120 accepts input from a user through a set of hand controls, and/or head, gesture, and/or eye tracking systems and outputs video, audio and/or other sensory output to a user interface. In many embodiments, the interactive controller 120 can exchange data with and accept control information from the application controller 112. In several embodiments an interactive controller 120 can be implemented using a casino gaming device such as a cabinet based casino game, a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific interactive application software program. In numerous embodiments, an interactive controller can be an electromechanical game system of an alternative application resource interleaved wagering system that is an electromechanical interleaved wagering system. An electromechanical interleaved wagering system executes an electromechanical game for user entertainment. The electromechanical game can be any game that utilizes both mechanical and electrical components, where the game operates as a combination of mechanical motions performed by at least one user or the electromechanical game itself.

The interactive controller 120 operates mostly independently from the application controller 112, except that, via the transfer of interactive application resources 136, the application controller 112 can send certain alternative application resource interleaved wagering system interactive application resources including control parameters to the interactive controller 120 to affect the interactive controller's execution, such as (but not limited to) changing the difficulty level of an interactive application that is an interactive game. In various embodiments, these interactive application control parameters can be based on a wagering outcome of a wagering mechanic that was triggered by an element in the alternative application resource interleaved wagering system interactive application being acted upon by the user. The interactive controller 120 can accept this input from the application controller 112, make adjustments, and continue alternative application resource interleaved wagering system interactive application interaction.

The interactive application's execution is mostly skill based, except for where the interactive application's processes can inject complexities into the interactive application by chance in its normal operation to create unpredictability in the alternative application resource interleaved wagering system interactive application. The interactive controller 120 can also communicate user choices made in the application to the application controller 112, included in the application telemetry 124, such as but not limited to the user's utilization of the elements of the interactive application during the user's skillful execution of the interactive application. The application controller's job in this architecture, being interfaced thusly to the interactive controller 120, is to allow the transparent coupling of an alternative application resource interleaved wagering system interactive application to a fair and transparent random chance wagering mechanic, providing a seamless perspective to the user that they are playing a typical popular alternative application resource interleaved wagering system interactive application (which is skill based).

In several embodiments, the wager controller 102 can accept a trigger to run a wagering mechanic in response to actions taken by the user in the alternative application resource interleaved wagering system interactive application as conveyed by the interactive controller 120 to the application controller 112 as triggered by the application controller 112 using trigger logic 126, background to the overall interleaved wagering system from the user's perspective, but can provide information to the application controller 112 to expose the user to certain aspects of the wagering mechanic, such as (but not limited to) odds, amount of RC in play, and amount of RC available. In various embodiments, the wager controller 102 can accept modifications in the amount of RC wagered on each individual wagering try, or the number of wagering mechanics per minute the wager controller 102 can execute, entrance into a bonus round, and other factors, all the while these factors can take a different form than that of a typical slot machine. An example of a varying wager amount that the user can choose can include but is not limited to interaction using a more difficult interactive application level. These choices can increase or decrease the amount wagered per individual wagering mechanic, in the same manner that a standard slot machine user can decide to wager more or less credits for each pull of the handle. In several embodiments, the wager controller 102 can communicate a number of factors back and forth to the application controller 112, via an interface, such that an increase/decrease in a wagered amount can be related to the user's decision making as to their user profile in the alternative application resource interleaved wagering system interactive application. In this manner, a user can be in control of a per-application wager amount, with the choice mapping to a parameter or component that is applicable to the alternative application resource interleaved wagering system interactive application experience.

In many embodiments, an alternative application resource interleaved wagering system integrates a video game style wagering machine, where the wagering mechanic (including an wager controller 102 and RC) is not user skill based, while at the same time allows users to use their skills to earn club points which a casino operator can translate to rewards, tournament opportunities and prizes for the users. The actual exchange of monetary funds earned or lost directly from wagering against a game of chance in a wagering mechanic, such as a slot machine, is preserved. At the same time a rich environment of rewards to stimulate gamers can be established with the interactive application. In several embodiments, the alternative application resource interleaved wagering system can leverage popular titles with gamers and provides a sea change environment for casinos to attract users with games that are more akin to the type of entertainment that a younger generation desires. In various embodiments, users can use their skill towards building and banking AC that in turn can be used to win tournaments and various prizes as a function of their gamer prowess. Numerous embodiments minimize the underlying changes applied to the aforementioned entertainment software for the interleaved wagering system to operate within an alternative application resource interleaved wagering system interactive application construct. Therefore, a plethora of complex game titles and environments can be rapidly and inexpensively be deployed in a wagering environment.

In some embodiments, the use of the wager controller, application controller and interactive controller allows for the separation of control of an alternative application resource interleaved wagering system between different devices. For example, the interactive controller may be hosted by a device that is separate from any devices that host the wager controller and/or application controller. Through separation of control of the functions of the interactive controller, wager controller and application controller, the wager controller may be isolated from the user's device, thus preventing user interference with the wager controller and the wagering mechanic. In addition, as the interactive controller is responsible for providing the interactive application, alternative application resource interleaved wagering systems may provide for complex interactive applications for the user as the interactive controller need not include the tightly regulated components of the wager controller, thus providing for more freedom in interactive controller design. In addition, separation of control allows an application controller to provide complex wager initiation rules that would not be possible if the either the interactive controller or the wager controller were to be in control of the wager initiation.

In some embodiments, an alternative application resource interleaved wagering system allows for interleaving of continuous wagering within an interactive application. For example, instead of wagering once, and then playing an interactive application to completion, or playing an interactive application to completion and then placing a wager, an alternative application resource interleaved wagering system allows a gaming system or device to be provided to a user where the gaming system or device provides a complex and interesting interactive application with wagering incorporated throughout the interactive application.

In various embodiments, an alternative application resource interleaved wagering system provides for feedback into the interactive application of additional interactive application resources that are made available in the interactive application for the use of the user as the result of wagering outcomes. The additional interactive application resources may enable portions of the interactive application that were not available to the user without the resources.

In many embodiments, an alternative application resource interleaved wagering system provides the ability to use the alternative application resource interleaved wagering system in more than one jurisdiction, as the interactive controller is a component separate from the application controller and wager controller. For example, the interactive controller may be operated as either a pure interactive application, or as a wagering mechanic depending on the type can characteristics of the wager controller that the interactive controller is coupled to.

In some embodiments, an alternative application resource interleaved wagering system provides for display of an interactive application on a user's device that the user is using to interact with the interactive application, as well as providing a separate display of a state of a wagering mechanic on a separate wagering mechanic display. The separate wagering mechanic display may be on the user's device within the same physical display device, on a separate device having a separate physical screen, or on a separate physical display device on the user's device.

In certain embodiments, alternative application resource interleaved wagering systems also allow users to gain entry into subsequent competitions through the accumulation of interactive application credits (AC) as a function of the user's demonstrated skill at the application. These competitions can pit individual users or groups of users against one another and/or against the operator of a wagering mechanic (such as but not limited to a casino) to win prizes based upon a combination of chance and skill. These competitions can be either asynchronous events, whereby users participate at a time and/or place of their choosing, or they can be synchronized events, whereby users participate at a specific time and/or venue.

In many embodiments, one or more users can be engaged in playing a skill based alternative application resource interleaved wagering system interactive application executed by the interactive controller. An alternative application resource interleaved wagering system can include an interactive application that includes head to head play between a single user and the computer, between two or more users against one another, or multiple users playing against the computer and/or each other, as well as a process by which user can bet on the outcome of an alternative application resource interleaved wagering system interactive application. The alternative application resource interleaved wagering system interactive application can also be a game where the user is not playing against the computer or any other user, such as in games where the user is effectively playing against himself or herself.

Figure 2:
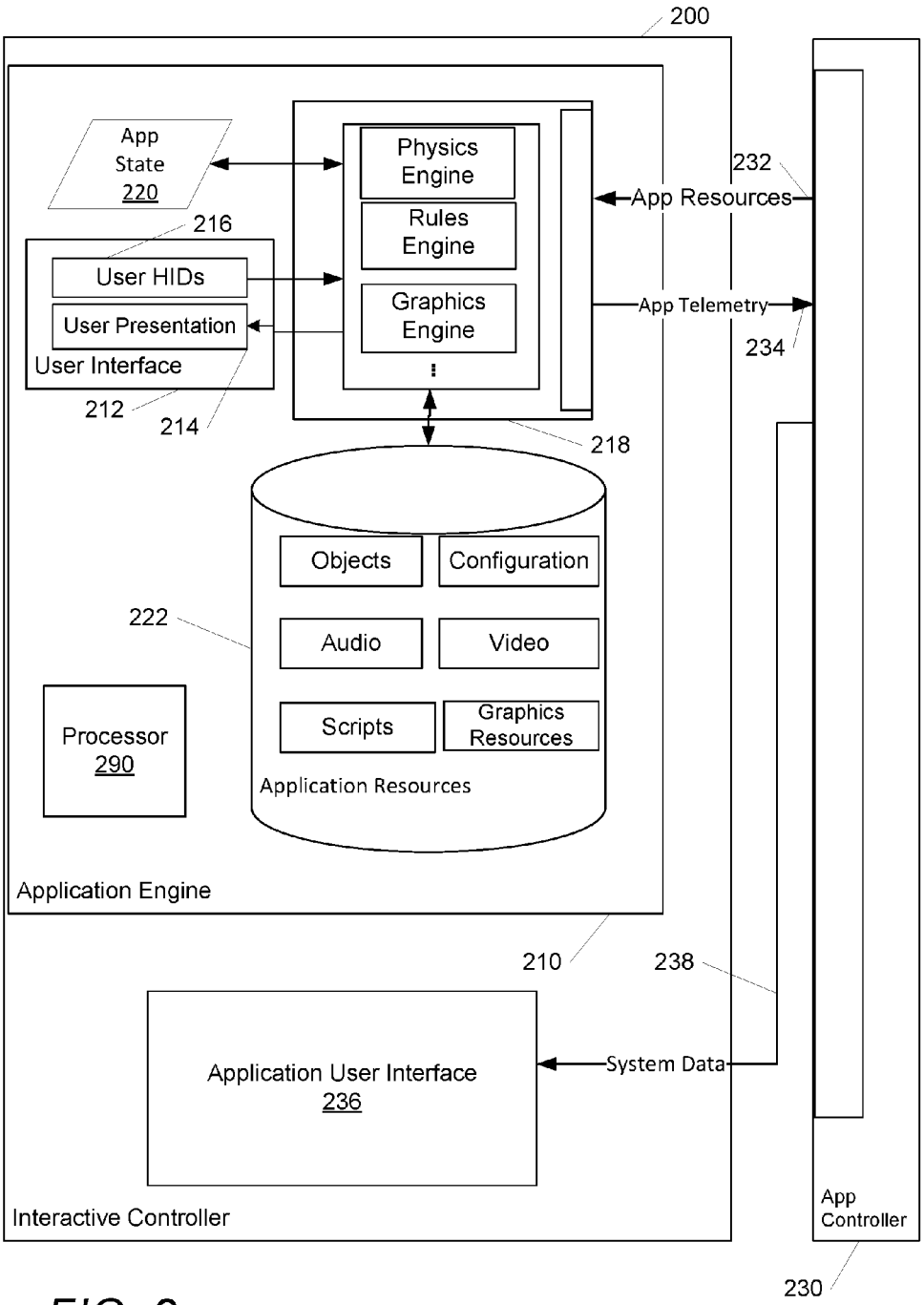
FIG. 2 illustrates an interactive application in accordance with embodiments of the invention.

FIG. 2 is a diagram of an interactive controller in accordance with an embodiment of the invention. The interactive controller 200 may be part of the interactive application itself, may be a software module that is executed by the interactive controller, or may provide an execution environment for the interactive application for a particular host. The interactive controller and an associated interactive application are hosted by an interactive controller device. The interactive controller device is a computing device that is capable of hosting the interactive controller. Embodiments of devices include, but are not limited to, electronic gaming machines, video game consoles, smart phones, personal computers, tablet computers, or the like. In several embodiments, an interactive controller of an alternative application resource interleaved wagering system includes an application engine 210 that generates a user interface 212 for interaction with by a user. The user interface includes a user presentation 214 that is presented to a user through the user interface. The user presentation may be audio, visual or tactile, or any combination of such. The user interface further includes one or more human input devices (HIDs) 216 that the user uses to interact with the alternative application resource interleaved wagering system. Various components or sub-engines 218 of the application engine read data from an application state 220 in order to implement the features of the interactive controller. In some embodiments, components of the application engine include, but are not limited to, a physics engine used to simulate physical interactions between virtual objects in the application state, a rules engine for implementing the rules of the interactive application, an RNG that may be used for influencing or determining certain variables and/or outcomes to provide a randomizing influence on interaction, a graphics engine used to generate a visual representation of the application state to the user, and an audio engine to generate audio outputs for the user interface. The interactive controller also includes a processor 290 configured to execute instructions for performing the functions of the interactive controller. The application controller also includes a processor configured to execute instructions for performing the functions of the application controller.

During operation, the application engine 210 reads and writes application resources 222 stored on a data store of the interactive controller host. The application resources include application objects having graphics and/or control logic used to implement interactive application objects of the interactive application. In various embodiments, the application resources may also include, but are not limited to, video files that are used to generate cut-scenes for the interactive application, audio files used to generate music, sound effects, etc. within the interactive application, configuration files used to configure the features of the interactive application, scripts or other types of control code used to implement various features of the interactive application, and graphics resources such as textures, objects, etc. that are used by the application engine to render objects displayed in the interactive application.

In operation, components of the application engine read portions of the application state and generate the user presentation for the user which is presented to the user using the user interface. The user perceives the presentation and provides user inputs using the HIDs. The corresponding user inputs are received as user actions or inputs by various components of the application engine. The application engine translates the user actions into interactions with the virtual objects of the interactive application stored in the application state. Components of the application engine use the user interactions with the virtual objects of the interactive application and the interactive application state to update the application state and update the presentation presented to the user. The process loops in a loop continuously while the user interacts with the alternative application resource interleaved wagering system.

In some embodiments, the interactive controller is a host running a browser that communicates with a server serving documents in a markup language, such as Hypertext Markup Language 5 (HTML 5) or the like, and the functions of the application engine are performed by the browser on the basis of the markup language found in the documents. In some embodiments, the interactive controller is a host hosting a specialized software platform, such as Adobe Flash or the like, used to implement applications or other types of multimedia presentations, and the functions of the application engine are performed by the specialized platform.

The interactive controller provides one or more interfaces between an interactive controller and other components of an alternative application resource interleaved wagering system, such as an application controller 230. The interactive controller and the other alternative application resource interleaved wagering system components communicate with each other using the interfaces, such as by passing various types of data and sending and receiving messages, status information, commands and the like. In certain embodiments, the interactive controller and application controller exchange interactive application resources 232 and application telemetry 234. In some embodiments, the communications include requests by the application controller that the interactive controller update the application state 220 using information provided by the application controller. Another embodiment of a communication is requesting by the application controller that the interactive controller update one or more application resources using information provided by the application controller. In another embodiment, communication is provided by the interactive controller of all or a portion of the application state. In some embodiments, interactive controller may also provide one or more of the application resources to the application controller. In some embodiments, the communication includes user actions that the interactive controller communicates to the application controller. The user actions may be low level user interactions with the user interface, such as manipulation of an HID, or may be high level interactions with objects as determined by the interactive application. The user actions may also include resultant actions such as modifications to the alternative application resource interleaved wagering system state or application resources resulting from the user's actions taken in the alternative application resource interleaved wagering system. In some embodiments, user actions include, but are not limited to, actions taken by entities, such as non-payer characters (NPC) of the interactive application, that act on behalf of, or under the control of, the user.

In some embodiments, the interactive controller includes an alternative application resource interleaved wagering system user interface 236 used to communicate alternative application resource interleaved wagering system data 238 to and from the user. The alternative application resource interleaved wagering system includes, but is not limited to, information used by the user to configure wagering mechanic RC wagers, and information about the wagering mechanic RC wagers, such as RC balances and RC amounts wagered.

Figure 3:
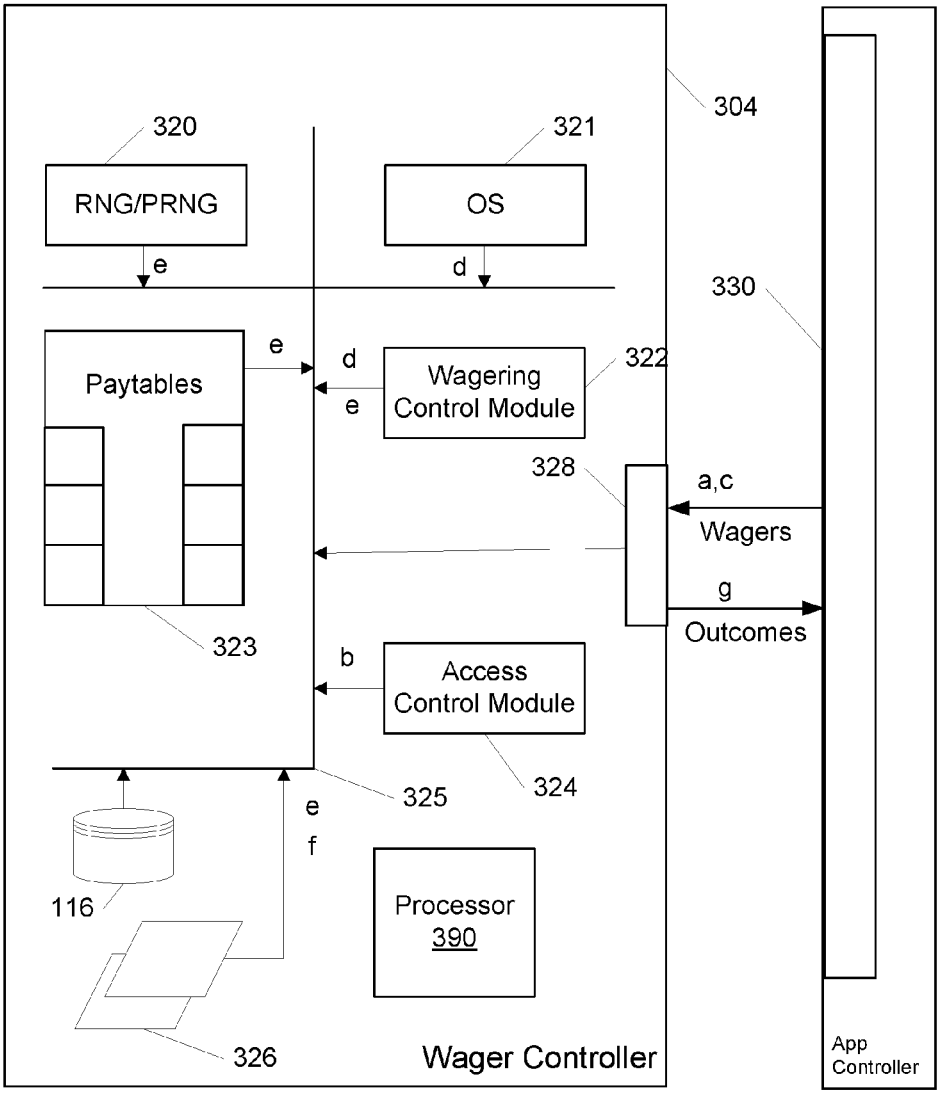
FIG. 3 illustrates a wager controller in accordance with embodiments of the invention.

FIG. 3 is an illustration of a wager controller is accordance with an embodiment of the invention. In this embodiment, the wager controller 304 has an operating system OS 321 which controls the functions of the wager controller, a random number generator (RNG) 320 to produce random numbers or pseudo random numbers, one or more pay tables 323 which includes a plurality of factors indexed by the random number to be multiplied with an amount of RC committed in a wager, a wagering control module 322 whose processes may include, but are not limited to, pulling random numbers, looking up factors in the pay tables, multiplying the factors by an amount of RC wagered, and administering one or more RC credit meters 326. The wager controller may also include storage for statuses, wagers, wager outcomes, meters and other historical events in a storage device 316. An authorization access module 324 provides a process to permit access and command exchange with the wager controller and access to a repository (a credit meter) 326 for the amount of RC which user has deposited in the alternative application resource interleaved wagering system. An external interface 328 allows the wager controller 304 to interface to another system or device, such as an application controller 330. Various wager controller modules and components interface with each other via an internal bus 325. The wager controller also includes a processor 390 configured to execute instructions for performing the functions of the wager controller. The application controller also includes a processor configured to execute instructions for performing the functions of the application controller.

In various embodiments, a wager controller may use an RNG that is an external system, connected to the wager controller by local area network (LAN) or a wide area network (WAN) such as the Internet. In some embodiments, the external RNG is a central deterministic system, such as a regulated and controlled random numbered ball selection device, or some other system which provides random or pseudo random numbers to one or a plurality of connected wager controllers.

In numerous embodiments, the method of interfacing an wager controller to other systems/devices or to an external RNG may be the Internet, but it should be noted that nothing would preclude using a different interface than the Internet in certain embodiments, such as a LAN, a USB interface, or some other method by which two electronic devices could communicate with each other.

In numerous embodiments, signaling occurs between various types of a wager controller and an external system, such as application controller 330. In some of these embodiments, the purpose of the wager controller is to manage wagering events and to provide random (or pseudo random) numbers from an RNG. The external system requesting wagering support instructs the wager controller as to the pay table to use, followed by the amount of RC to wager. Next, the external system signals the wager controller to trigger a wager, followed by the wager controller informing the external system as to the outcome of the wager, the amount of RC won, and lastly the amount of RC in the user's account in the credit repository.

In various embodiments, a second communication exchange between various types of a wager controllers and an external system relates to the external system using an RNG result support from the wager controller. In this exchange, the external system requests an RNG result from the wager controller, and the wager controller returns an RNG result, as a function of the wager controller's internal RNG, or from an RNG external to the wager controller to which the wager controller is connected.

In some embodiments, communication exchange between various types of a wager controller and an external system relate to the external system wanting support on coupling an RNG result to a particular pay table contained in the wager controller. In such an exchange, the external system instructs the wager controller as to the pay table to use, and then requests a result whereby the RNG result would be coupled to the requested pay table, and this result would be returned to the external system. In such an exchange, no actual RC wager is conducted, but might be useful in coupling certain non-RC wagering interactive application behaviors and propositions to the same final resultant wagering return which is understood for the alternative application resource interleaved wagering system to conduct wagering.

In numerous embodiments, some or all of the various commands and responses illustrated could be combined into one or more communication packets.

The following table illustrates a process for operation of the wager controller in accordance with various embodiments:

Sequence 1—Place a Wager

| | |
|---|---|
| a | An external system signals the wager controller 304 that it wishes to connect to the wager controller 304 and forwards its credentials. |
| b | The wager controller's access control module 324 determines that the external system is safe to connect to and indicates so to the external system |
| c | The external system signals the wager controller that it wishes to wager controller to perform a wager and communicates the pay table to use, and the amount of RC to wager and triggers the wager. |
| d | The OS 321 instructs the wager control module 322 as to the RC wager and the pay table to select, and to execute. |
| e | The wager control module 322 pulls: an RNG result from the RNG 320, a Pay Table result from the pay tables 323, RC from the RC repository 326 as instructed, and applies a random number to the particular pay table and multiplies the resultant factor from the pay table by the amount of RC to determine the result of the wager. |
| f | The amount of RC won in the wager is added to the RC repository 326. |
| g | The outcome of the wager, and the amount of RC in the wager controller and the RC won is communicated to the external system. |

It should be understood that there may be many embodiments of an wager controller 304 which could be possible, including forms where many modules and components of the wager controller are located in various servers and locations, so the foregoing is not meant to be exhaustive or all inclusive, but rather provide information on various embodiments of an wager controller 304.

Figure 4:
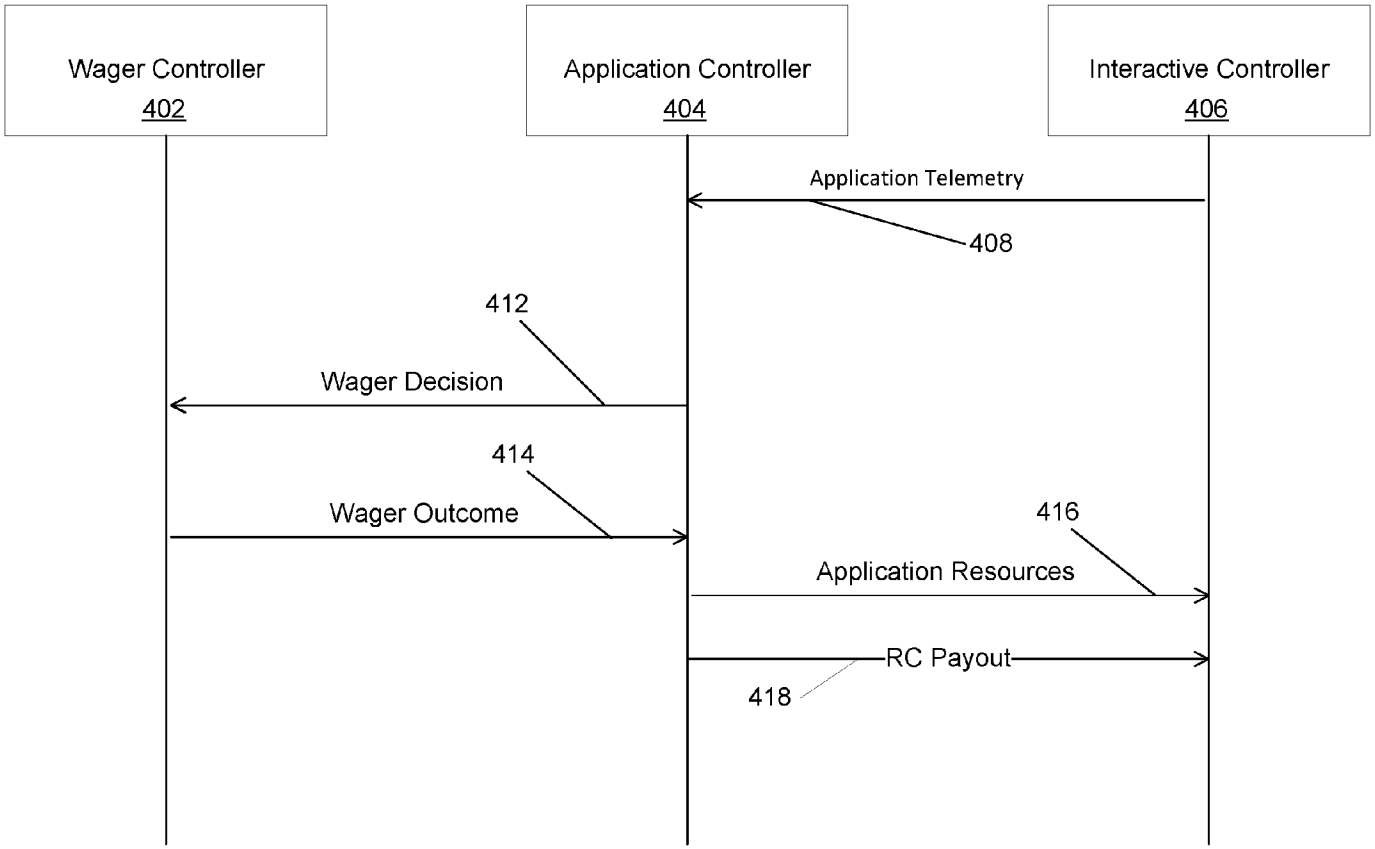
FIG. 4 is a timing diagram that illustrates a process of facilitating interactions between an alternative application resource interleaved wagering system interactive application and an alternative application resource interleaved wagering system wagering mechanic in accordance with embodiments of the invention.
Figure 5A:
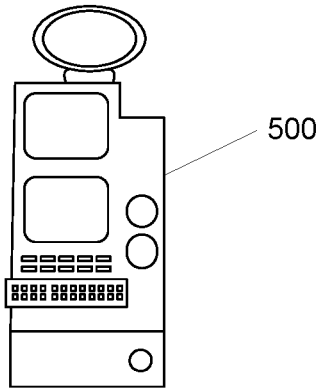
FIGS. 5A, 5B, 5C, and 5D illustrate various devices that host an alternative application resource interleaved wagering system in accordance with embodiments of the invention.
Figure 5B:
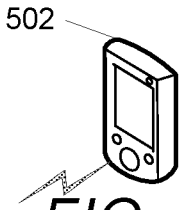
Figure 5C:
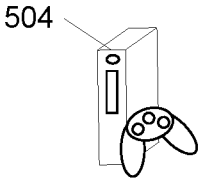
Figure 5D:
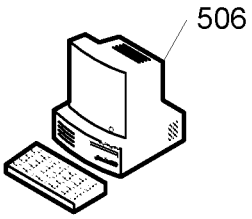

FIG. 4 is a timing diagram that illustrates a process of facilitating interactions between an alternative application resource interleaved wagering system interactive application and a wagering mechanic in accordance with embodiments of the invention. The process includes a user performing a user action using a user interface. An interactive controller 406 signals (408) an application controller 404 of application telemetry, including but not limited to a user interaction with the interactive controller 406. In some embodiments, the application controller 404 signals the interactive controller as to the amount of EE that will be consumed by the user action in return. The signal can configure a function that controls EE consumption, decay or addition for the interactive controller. The interactive controller 406 can, based upon the function, consume an amount of EE designated by the application controller 404 to couple to the activity. Upon detection that the user action should initiate a wagering event, the application controller 404 signals an wager controller 402 as to the wager terms associated with the wagering event in a triggered (412) wager. The wager controller 402 can consume RC in executing the wager. The wager controller 402 can return RC as a payout from the wager. The wager controller 402 can inform (414) the application controller 404 as to the wager outcome such as a payout from the wager. The application controller 404 can signal (416) the interactive controller 406 to ascribe interactive application resources that should be provided to the interactive controller for use by the user, such as a payout of EE based upon the wager. The application controller can signal the interactive controller of the amount of RC payout as a payout from the wager. The interactive controller 406 can reconcile and combine the payout of EE with the EE already ascribed to the user in the alternative application resource interleaved wagering system interactive application. In various embodiments, the interactive controller 406 can signal the application controller 404 as to its updated status based upon reconciling the payout of EE, and the application controller 404 can signal the interactive controller 406 of a payout of AC in response to the status update.

In certain embodiments, the sequence of events in the timing diagram of FIG. 4 can be reflected in an interactive application of an interleaved wagering system. For example, a user can take an action, such as selecting a number to be placed in a section of a Sudoku board. The interactive controller can signal (408) the application controller of the user action, such as but not limited to signaling the application controller as to the user's choice of the symbol, the position on the Sudoku puzzle board that the symbol is played and whether or not the symbol as played was a correct symbol in terms of eventually solving the Sudoku puzzle. The application controller can process the information concerning the placement of the symbol, and signal (410) the interactive controller to consume a symbol (EE) with each placement. The interactive application then will consume the number (EE) based upon the placement of the symbol. The application controller can also signal (412) the wager controller that 3 credits of RC are to be wagered to match the placement of the symbol as (EE) that is consumed, on a particular pay table (table Ln-RC). The wager controller can consume the 3 credits for the wager and execute the specified wager. In executing the wager, the wager controller can determine that the user hits a jackpot of 6 credits, and allocate the 6 credits of RC to the credit meter. The wager controller can also inform (414) the application controller that 6 credits of RC net were won as a payout from the wager. The application controller can signal (416) the interactive controller to add 2 additional symbols (EE) to the symbol of symbols available to a user based upon the wagering payout. The interactive controller can then add 2 symbols (EE) to the number of symbol placements available to a user in the interleaved wagering system interactive application. The application controller can receive an update from the interactive controller as to the total amount of EE associated with the user. The application controller can log the new user score (AC) in the application (as a function of the successful placement of the symbol) based on the update, and signal the interactive controller to add 2 extra points of AC to the user's score.

In many embodiments, a user can bet on whether or not the user will beat another user in an interactive application that is an interactive game. These bets can be made, for example, on the final outcome of the game, and/or the state of the game along various intermediary points (such as but not limited to the score at the end of a period of time of an alternative application resource interleaved wagering system interactive application session) and/or on various measures associated with the game. Users can bet against one another, or engage the computer in a head to head competition in the context of their skill level in the alternative application resource interleaved wagering system interactive application in question. As such, users can have a handicap associated with their user profile that describes their skill (which can be their professed skill in certain embodiments), and which is used by an application controller (such as a local application controller or an application controller that receives services from remote servers) to offer appropriate bets around the final and/or intermediate outcomes of the alternative application resource interleaved wagering system interactive application, and/or to condition sponsored interaction as a function of user skill, and/or to select users across one or more alternative application resource interleaved wagering systems to participate in head to head games and/or tournaments.

Many embodiments enable the maximization of the number of users able to compete competitively by enabling handicapping of users by utilizing a skill normalization module that handicaps users to even the skill level of users competing against each other. Handicapping enables users of varying performance potential to compete competitively regardless of absolute skill level, such as but not limited to where a user whose skill level identifies the user as a beginner can compete in head to head or tournament play against a highly skilled user with meaningful results.

In several embodiments, wagers can be made among numerous alternative application resource interleaved wagering systems with a global betting manager (GBM). The GBM is a system that coordinates wagers that are made across multiple alternative application resource interleaved wagering systems by multiple users. In some implementations it can also support wagers by third parties relative to the application performance of other users. The GBM can stand alone, or is capable of being embedded in one of a number of systems, including an application controller, interactive controller or any remote server capable of providing services to an alternative application resource interleaved wagering system, or can operate independently on one or a number of servers on-site at a casino, as part of a larger network and/or the Internet or cloud in general.

Although various components of alternative application resource interleaved wagering systems are discussed above, alternative application resource interleaved wagering systems can be configured with any component as appropriate to the specification of a specific application in accordance with embodiments of the invention. In certain embodiments, components of an alternative application resource interleaved wagering system, such as an application controller, wager controller, interactive controller can be configured in different ways for a specific alternative application resource interleaved wagering system application. Network connected alternative application resource interleaved wagering systems are discussed below.

Stand-Alone Alternative Application Resource Interleaved Wagering Systems

FIGS. 5A to 5D illustrate various types of devices that may be used to host an alternative application resource interleaved wagering system as a stand-alone device in accordance with embodiments of the invention. An electronic gaming machine 500 may be used to host an alternative application resource interleaved wagering system. The electronic gaming machine 500 may be physically located in casino or other gaming establishment. A portable device 502, such as a tablet computer or a smartphone may be used to host an alternative application resource interleaved wagering system. A gaming console 504 may be used to host an alternative application resource interleaved wagering system. A personal computer 506 may be used to host an alternative application resource interleaved wagering system.

Network Connected Alternative Application Resource Interleaved Wagering Systems

Some alternative application resource interleaved wagering systems in accordance with many embodiments of the invention can operate locally while being network connected to draw services from remote locations or to communicate with other alternative application resource interleaved wagering systems. In many embodiments, operations associated with an alternative application resource interleaved wagering system utilizing an alternative application resource interleaved wagering system interactive application can be performed across multiple devices. These multiple devices can be implemented using a single server or a plurality of servers such that an alternative application resource interleaved wagering system is executed as a system in a virtualized space, such as (but not limited to) where the wager controller and application controller are large scale centralized servers in the cloud coupled to a plurality of widely distributed interactive controller controllers or clients via the Internet.

In many embodiments, a wager controller server can perform certain functionalities of a wager controller of an alternative application resource interleaved wagering system. In certain embodiments, a wager controller server includes a centralized odds engine which can generate random outcomes (such as but not limited to win/loss outcomes) for a wagering mechanic. The wager controller server can perform a number of simultaneous or pseudo-simultaneous runs in order to generate random outcomes for a variety of odds percentages that one or more networked alternative application resource interleaved wagering systems can use. In certain embodiments, a wager controller of an alternative application resource interleaved wagering system can send information to a wager controller server including (but not limited to) paytables, maximum speed of play for a wagering mechanic, wagering mechanic monetary denominations or any promotional RC provided by the operator of the alternative application resource interleaved wagering system. In particular embodiments, a wager controller server can send information to a wager controller of an alternative application resource interleaved wagering system including (but not limited to) RC used in the wagering mechanic, user profile information or play activity and a profile associated with a user.

In several embodiments, an application controller server can perform the functionality of the application controller across various alternative application resource interleaved wagering systems. These functionalities can include (but are not limited to) providing a method for monitoring high scores on select groups of games, coordinating interactions between application layers, linking groups of games in order to join them in head to head tournaments, and acting as a tournament manager.

In a variety of embodiments, management of user profile information can be performed by a patron management server separate from an application controller server. A patron management server can manage information related to a user profile, including (but not limited to) data concerning controlled entities (such as characters used by a user in alternative application resource interleaved wagering system interactive application session), game scores, elements, RC and AC associated with particular users and managing tournament reservations. Although a patron management server is discussed separate from an application controller server, in certain embodiments an application controller server also performs the functions of a patron management server. In certain embodiments, an application controller of an alternative application resource interleaved wagering system can send information to a patron management server including (but not limited to) AC and RC used in a game, user profile information, play activity and profile information for users and synchronization information between a wagering mechanic and an alternative application resource interleaved wagering system interactive application or other aspects of an alternative application resource interleaved wagering system. In particular embodiments, a patron management server can send information to an application controller of an alternative application resource interleaved wagering system including (but not limited to) alternative application resource interleaved wagering system interactive application title and type, tournament information, table Ln-AC tables, special offers, character or profile setup and synchronization information between a wagering mechanic and an alternative application resource interleaved wagering system interactive application or other aspects of an alternative application resource interleaved wagering system.

In numerous embodiments, an interactive controller server provides a host for managing head to head play, operating on the network of interactive controllers which are connected to the interactive controller server by providing an environment where users can compete directly with one another and interact with other users. Although an interactive controller server is discussed separate from an application controller server, in certain embodiments the functionalities of an interactive controller server and application controller server can be combined in a single server.

Servers connected via a network to implement alternative application resource interleaved wagering systems in accordance with many embodiments of the invention can communicate with each other to provide services utilized by an alternative application resource interleaved wagering system. In several embodiments a wager controller server can communicate with an application controller server. A wager controller server can communicate with an application controller server to communicate any type of information as appropriate for a specific application, including (but not limited to): information used to configure the various simultaneous or pseudo simultaneous odds engines executing in parallel within the wager controller to accomplish alternative application resource interleaved wagering system functionalities, information used to determine metrics of wager controller performance such as random executions run and outcomes for tracking system performance, information used to perform audits, provide operator reports, and information used to request the results of a random run win/loss result for use of function operating within the application controller (such as where automatic drawings for prizes are a function of interactive controller performance).

In several embodiments an application controller server can communicate with an interactive controller server. An application controller server can communicate with an interactive controller server to communicate any type of information as appropriate for a specific application, including (but not limited to): the management of an interactive controller server by an application controller server during an alternative application resource interleaved wagering system tournament. Typically an application controller (such as an application controller that runs within an alternative application resource interleaved wagering system or on an application controller server) is not aware of the relationship of itself to the rest of a tournament, since in a typical configuration the actual tournament play is managed by the interactive controller server. Therefore, management of an alternative application resource interleaved wagering system tournament can include (but is not limited to) tasks such as: conducting tournaments according to system programming that can be coordinated by an operator of the alternative application resource interleaved wagering system; allowing entry of a particular user into a tournament; communicating the number of users in a tournament and the status of the tournament (such as but not limited to the amount of surviving users, their status within the game, time remaining on the tournament); communicating the performance of its users within the tournament; communicating the scores of the various members in the tournament; and providing a synchronizing link to connect the application controllers in a tournament with their respective interactive controllers.

In several embodiments an application controller server can communicate with a patron management server. An application controller server can communicate with a patron management server to communicate any type of information as appropriate for a specific application, including (but not limited to) information for configuring tournaments according to system programming conducted by an operator of an alternative application resource interleaved wagering system, information for exchange of data used to link a user's user profile to their ability to participate in various forms of alternative application resource interleaved wagering system interaction (such as but not limited to the difficulty of play set by the application controller server or the application controller), information for determining a user's ability to participate in a tournament as a function of a user's characteristics (such as but not limited to a user's gaming prowess or other metrics used for tournament screening), information for configuring application controller and interactive controller performance to suit preferences of a user on a particular alternative application resource interleaved wagering system, information for determining a user's play and wagering performance for the purposes of marketing intelligence, and information for logging secondary drawing awards, tournament prizes, RC and AC into the user profile.

In many embodiments, the actual location of where various process are executed can be located either in the application contained devices (wager controller, application controller, interactive controller), on the servers (wager controller server, application controller server, or interactive controller server), or a combination of both application contained devices and servers. In particular embodiments, certain functions of a wager controller server, application controller server, patron management server or interactive controller server can operate on the local wager controller, application controller or interactive controller contained with an alternative application resource interleaved wagering system locally. In certain embodiments, a server can be part of a server system including a plurality of servers, where software can be run on one or more physical devices. Similarly, in particular embodiments, multiple servers can be combined on a single physical device.

Figure 6A:
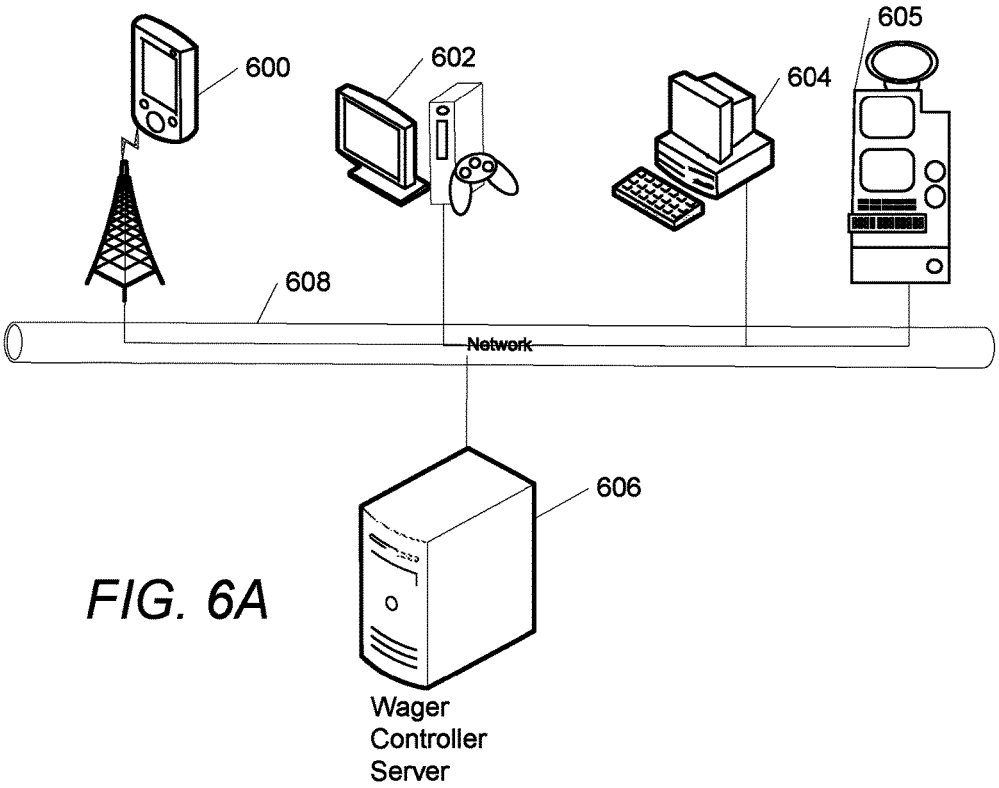
FIGS. 6A, 6B and 6C illustrate embodiments of a distributed alternative application resource interleaved wagering system in accordance with embodiments of the invention.

Some alternative application resource interleaved wagering systems in accordance with many embodiments of the invention can be networked with remote servers in various configurations. Networked alternative application resource interleaved wagering system in accordance with embodiments of the invention are illustrated in FIG. 6A. As illustrated, one or more end devices of networked alternative application resource interleaved wagering systems, such as a mobile device 600, a gaming console 602, a personal computer 604, and an electronic gaming machine 605, are connected with a wager controller server 606 over a network, such as a LAN or a WAN, 608. In these embodiments, the processes of an interactive controller and an application controller as described herein are executed on the individual end devices 600, 602, 604 and 605 while the processes of the wager controller as described herein are executed by the wager controller server 606.

Figure 6B:
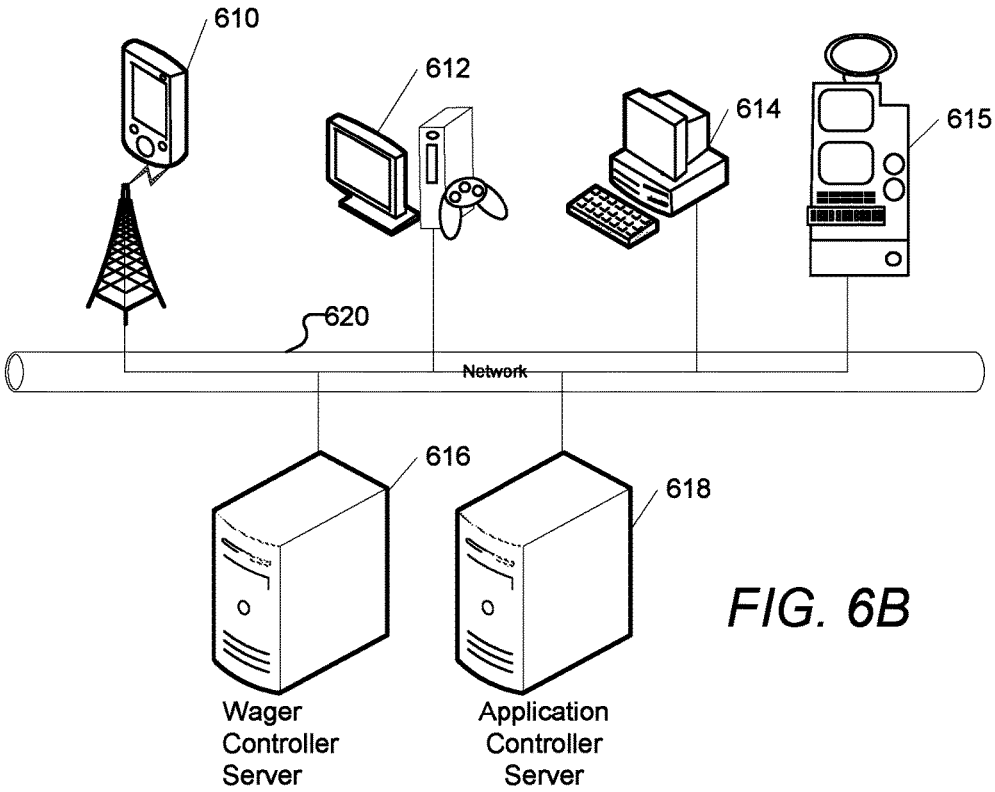

Other networked alternative application resource interleaved wagering systems in accordance with embodiments of the invention are illustrated in FIG. 6B. As illustrated, one or more end devices of networked alternative application resource interleaved wagering systems, such as a mobile device 610, a gaming console 612, a personal computer 614, and an electronic gaming machine 615, are connected with a wager controller server 616 and an application controller server 618 over a network, such as a LAN or a WAN, 620. In these embodiments, the processes of an interactive controller as described herein are executed on the individual end devices 610, 612, 614 and 615 while the processes of the wager controller as described herein are executed by the wager controller server and the process of the application controller as described herein are executed by the application controller server.

Figure 6C:
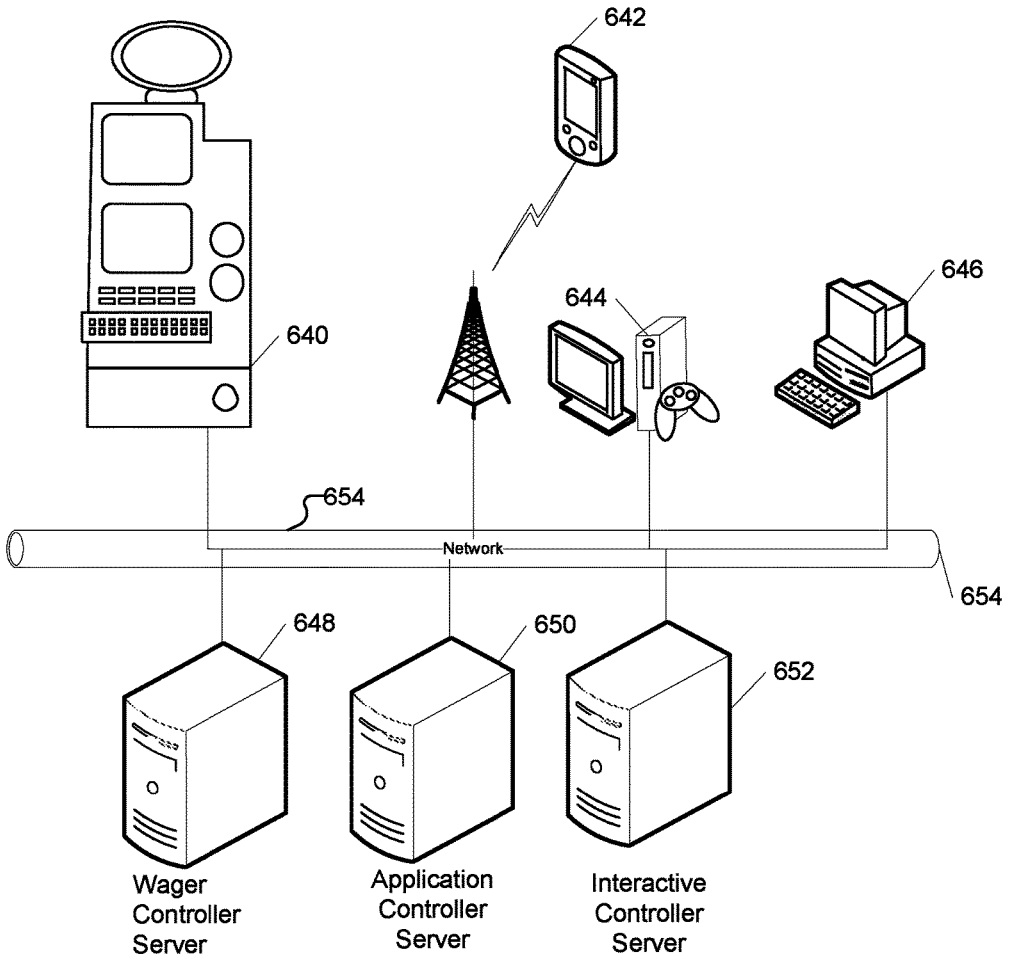

Additional networked alternative application resource interleaved wagering systems in accordance with embodiments of the invention are illustrated in FIG. 6C. As illustrated, one or more end devices of networked alternative application resource interleaved wagering systems, such as a mobile device 642, a gaming console 644, a personal computer 646, and an electronic gaming machine 640, are connected with an wager controller server 648 and an application controller server 650, and an interactive controller server 652 over a network, such as a LAN or a WAN, 654. In these embodiments, the processes of a display and user interface of an interactive controller as described herein are executed on the individual end devices 640, 642, 644 and 646 while the processes of the wager controller as described herein are executed by the wager controller server, the processes of the application controller as described herein are executed by the application controller server, and the processes of an interactive controller excluding the display and user interfaces are executed on the interactive controller server 652.

In various embodiments, a patron management server may be operatively connected to components of an alternative application resource interleaved wagering system via a network. In other embodiments, a number of other peripheral systems, such as user management, casino management, regulatory, and hosting servers can also interface with the alternative application resource interleaved wagering systems over a network within an operator's firewall. Also, other servers can reside outside the bounds of a network within an operator's firewall to provide additional services for network connected alternative application resource interleaved wagering systems.

In numerous embodiments, a network distributed alternative application resource interleaved wagering system can be implemented on multiple different types of devices connected together over a network. Any type of device can be utilized in implementing a network distributed alternative application resource interleaved wagering system, such as but not limited to a gaming cabinet as used in a traditional land-based casino or a mobile computing device (such as but not limited to a PDA, smartphone, tablet computer or laptop computer), a game console (such as but not limited to a Sony PlayStation®, or Microsoft Xbox®) or on a Personal Computer (PC). Each of the devices may be operatively connected to other devices or other systems of devices via a network for the playing of head-to-head games.

Although various networked alternative application resource interleaved wagering systems are discussed above, alternative application resource interleaved wagering systems can be networked in any configuration as appropriate to the specification of a specific application in accordance with embodiments of the invention. In certain embodiments, components of a networked alternative application resource interleaved wagering system, such as an application controller, wager controller, interactive controller or servers that perform services for an application controller, wager controller or interactive controller, can be networked in different configurations for a specific networked alternative application resource interleaved wagering system application. Alternative application resource interleaved wagering system implementations are discussed herein. Processing apparatuses that can be implemented in an alternative application resource interleaved wagering system are discussed below.

Processing Apparatuses

Figure 7:
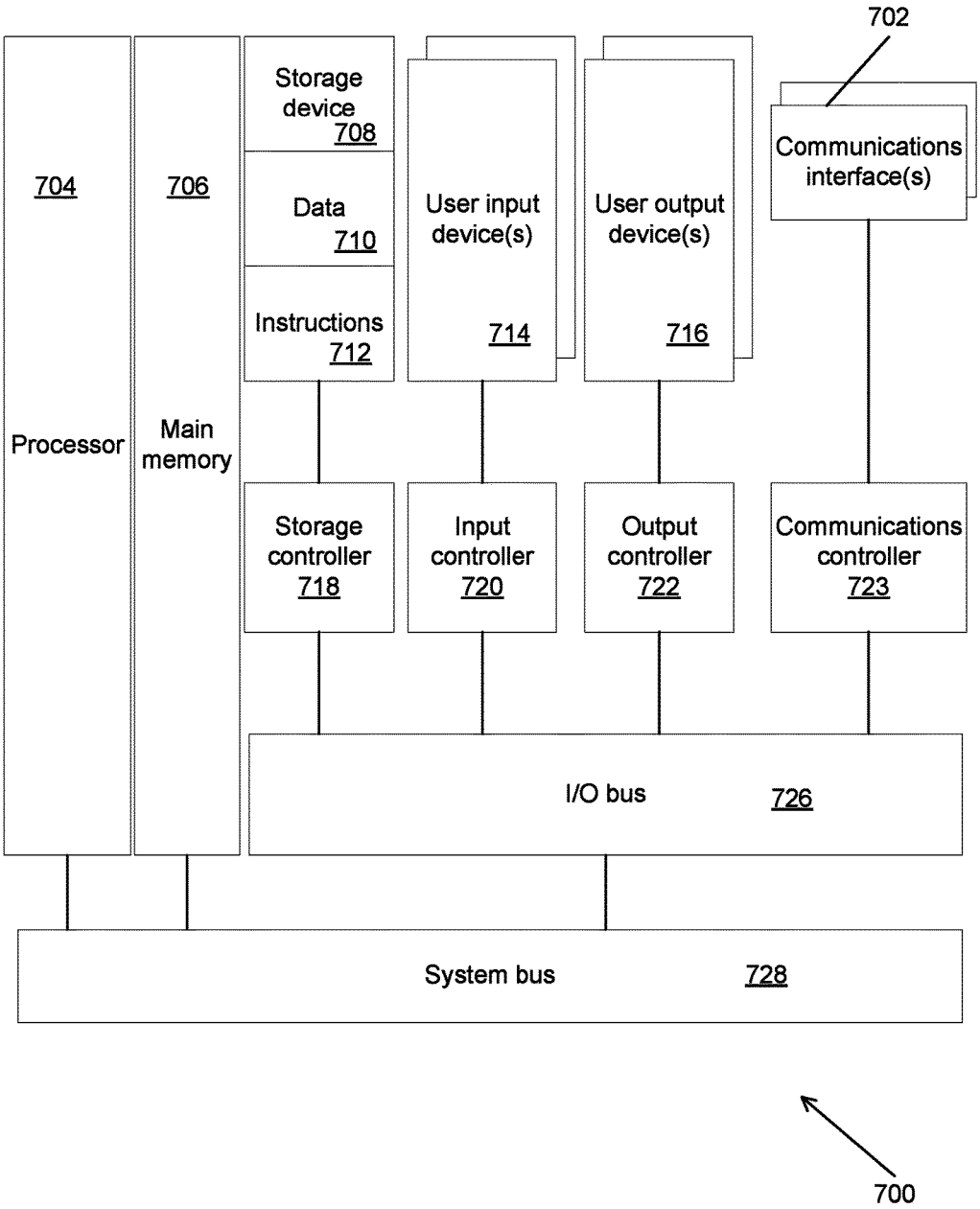
FIG. 7 is an illustration of a processing apparatus in accordance with various embodiments of the invention.

Any of a variety of processing apparatuses can host various components of an alternative application resource interleaved wagering system in accordance with embodiments of the invention. In several embodiments, these processing apparatuses can include, but are not limited to, a mobile device such as a tablet computer or a smartphone, an electronic gaming machine, a general purpose computer, a computing device and/or a controller. A processing apparatus that is constructed to implement all or part of an alternative application resource interleaved wagering system in accordance with an embodiment of the invention is illustrated in FIG. 7. In the processing apparatus 700, a processor 704 is coupled to a memory 706 by a bus 728. The processor 704 is also coupled to non-transitory processor-readable storage media, such as a storage device 708 that stores processor-executable instructions 712 and data 710 through the system bus 728 to an I/O bus 726 through a storage controller 718. The processor 704 is also coupled to one or more interfaces that can be used to connect the processor to other processing apparatuses as well as networks as described herein. The processor 704 is also coupled via the bus to user input devices 714, such as tactile devices including but not limited to keyboards, keypads, foot pads, touch screens, and/or trackballs, as well as non-contact devices such as audio input devices, motion sensors and motion capture devices that the processing apparatus can use to receive inputs from a user when the user interacts with the processing apparatus. The processor 704 is connected to these user input devices 714 through the system bus 728, to the I/O bus 726 and through the input controller 720. The processor 704 is also coupled via the bus to user output devices 716 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 728 to the I/O bus 726 and through the output controller 722. The processor 704 can also be connected to a communications interface 702 from the system bus 728 to the I/O bus 726 through a communications controller 724.

In various embodiments, a processor can load instructions and data from the storage device into the memory. The processor can also execute instructions that operate on the data to implement various aspects and features of the components of an alternative application resource interleaved wagering system as described herein. The processor can utilize various input and output devices in accordance with the instructions and the data in order to create and operate user interfaces for users or operators of an alternative application resource interleaved wagering system (such as but not limited to a casino that hosts the alternative application resource interleaved wagering system).

Although the processing apparatus is described herein as being constructed from a processor and instructions stored and executed by hardware components, the processing apparatus can be composed of only hardware components, or any combination thereof, in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an wager controller, application controller or interactive controller as described herein can be implemented on multiple processing apparatuses, whether dedicated, shared or distributed in any combination thereof, or can be implemented on a single processing apparatus. In addition, while certain aspects and features of alternative application resource interleaved wagering system processes described herein have been attributed to an wager controller, application controller, or interactive controller, these aspects and features can be implemented in a distributed form where any of the features or aspects can be performed by any of a wager controller, application controller, interactive controller within an alternative application resource interleaved wagering system without deviating from the spirit of the invention.

Alternative Application Resource Interleaved Wagering System Implementations

Figure 9:
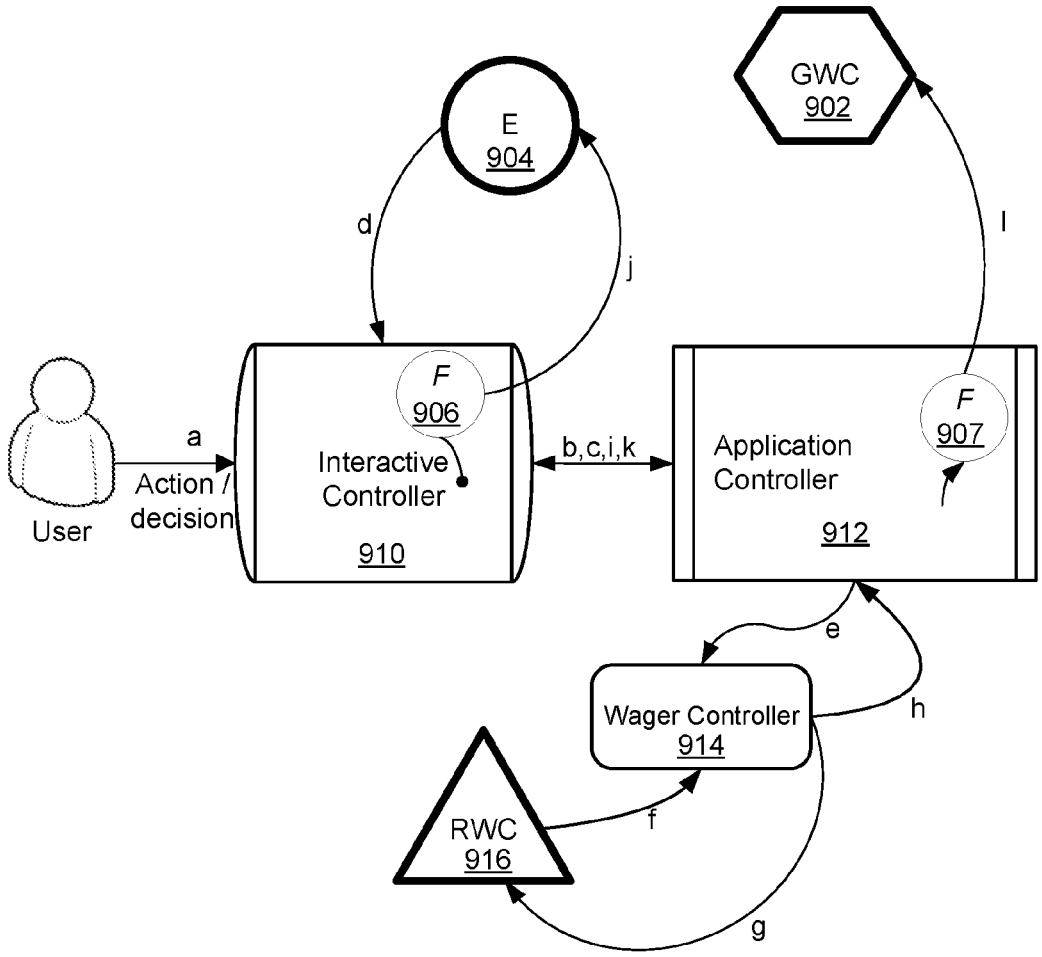
FIG. 9 is a process flow diagram that illustrates interplay between resources and components of an alternative application resource interleaved wagering system in accordance with embodiments of the invention.

In several embodiments, a user can interact with an alternative application resource interleaved wagering system by using RC in interactions with a wagering mechanic along with AC and elements in interactions with an alternative application resource interleaved wagering system interactive application. The wagering mechanic can be executed by a wager controller while an alternative application resource interleaved wagering system interactive application can be executed with an interactive controller and managed with an application controller. A conceptual diagram that illustrates how resources such as AC, RC and interactive application elements, such as but not limited to EE, are utilized in an alternative application resource interleaved wagering system in accordance with an embodiment of the invention is illustrated in FIG. 9. The conceptual diagram illustrates that RC 904, EE 908 and AC 906 can be utilized by a user 902 in interactions with the wager controller 910, application controller 912 and interactive controller 914 of an alternative application resource interleaved wagering system 916. The contribution of elements, such as EE 208, can be linked to a user's access to credits, such as RC 904 or AC 906. Electronic receipt of these credits can come via a smart card, voucher or other portable media, or as received over a network from a server. In certain implementations, these credits can be drawn on demand from a user profile located in a database locally on an alternative application resource interleaved wagering system or in a remote server.

Figure 8:
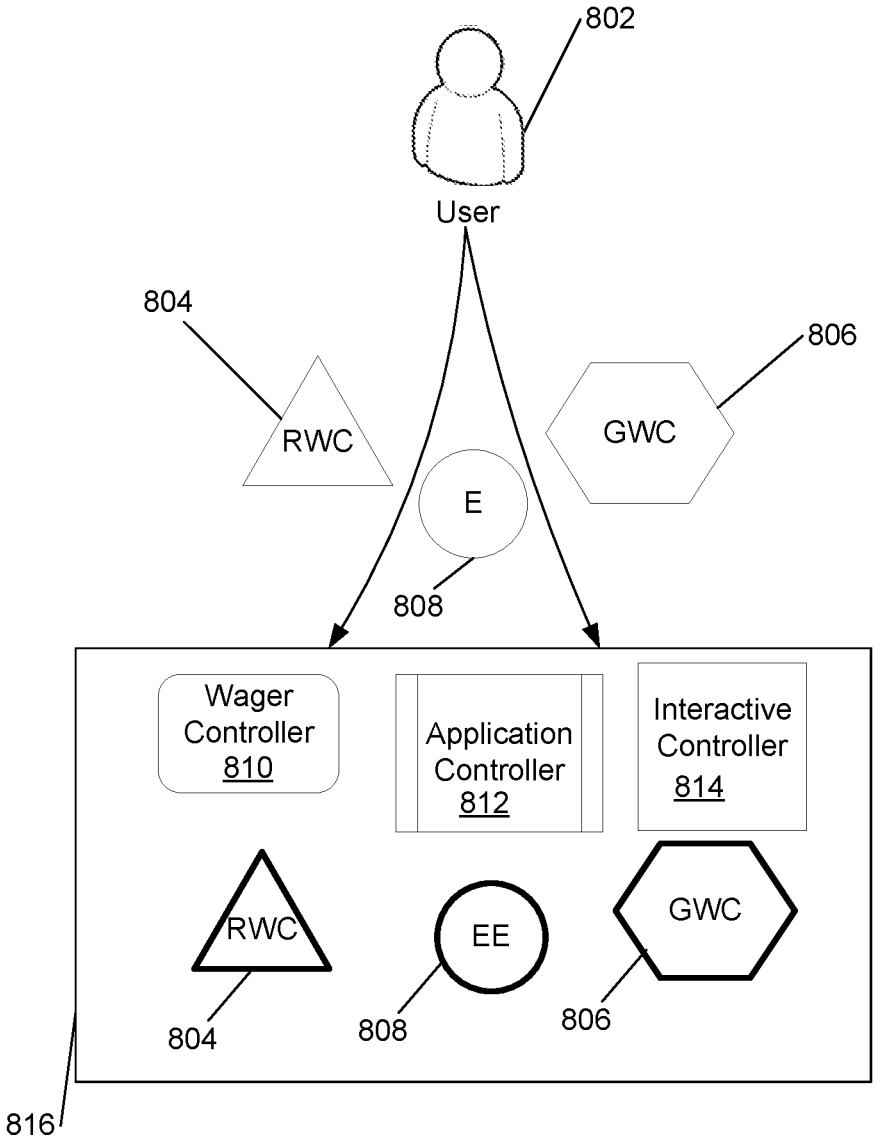
FIG. 8 is a process flow diagram that illustrates how resources are utilized in an alternative application resource interleaved wagering system in accordance with embodiments of the invention.

A conceptual diagram that illustrates interplay between elements and components of an alternative application resource interleaved wagering system in accordance with an embodiment of the invention is illustrated in FIG. 9. Similar to FIG. 8, a user's actions and/or decisions can affect functions 906 that consume and/or accumulate AC 902 and/or EE 904 in an alternative application resource interleaved wagering system interactive application executed by an interactive controller 910, a wager controller 914 and an application controller 912. The application controller 912 can monitor the activities taking place within an alternative application resource interleaved wagering system interactive application executed by an interactive controller 910 for wagering event occurrences. The application controller 912 can also communicate the wagering event occurrences to the wager controller 914 that triggers a wager of RC 916 in a wagering mechanic executed by the wager controller 914.

In the figure, the user commences interaction with the alternative application resource interleaved wagering system by contributing one or more of three types of credits to the alternative application resource interleaved wagering system, the three being: (i) RC 916 which is a currency fungible instrument, (ii) AC 902 which are interactive application credits, and (iii) EE 904 which is the enabling element (EE) of the entertainment portion of the alternative application resource interleaved wagering system executed by the interactive controller. In many embodiments, an EE is an element consumed by, traded or exchange in, operated upon, or used to enable the interactive application portion of the alternative application resource interleaved wagering system. There may be one or more types of EE present in an alternative application resource interleaved wagering system's interactive application. Embodiments of EE include, but are not limited to, bullets in a shooting game, fuel in a racing game, letters in a word spelling game, downs in a football game, portions in a character adventure game, character health points, etc.

The contribution of one or more of these elements may be executed by insertion into the alternative application resource interleaved wagering system of currency in the case of RC, and/or transferred in as electronic credit in the case of any of the RC, AC and EE. Electronic transfer in of these credits may come via a smart card, voucher or other portable media, or as transferred in over a network from a patron server or alternative application resource interleaved wagering system user account server. In certain implementations, these credits may not be transferred into the alternative application resource interleaved wagering system, but rather drawn on demand from user accounts located in servers residing on the network or in the cloud on a real time basis as the credits are consumed by the alternative application resource interleaved wagering system. Once these credits are deposited, or a link to their availability is made, the alternative application resource interleaved wagering system has them at its disposal to use for execution of the alternative application resource interleaved wagering system. Generally, the RC is utilized by and accounted for by the wager controller 914, and the EE 904 and AC 902 are utilized and accounted for by the application controller and/or the interactive controller.

An operation of the alternative application resource interleaved wagering system is illustrated by the following table:

| | |
|---|---|
| a | the user performs an action or makes a decision through the alternative application resource interleaved wagering system UI |
| b | the interactive controller signals the application controller of the user decision or action taken |
| c | the application controller signals the interactive controller as to the amount of EE that will be consumed by the user action or decision. This signaling configures function 906 to control the EE consumption, decay or addition |
| d | the interactive controller consumes the amount of EE designated by the application controller to couple to the user action |
| e | the application controller signals the wager controller as to the profile of the wager proposition associated with the particular action, and triggers the wager |
| f | the wager controller consumes RC for the wager and executes the wager |
| g | the wager controller returns RC depending on the outcome of the wager |
| h | the wager controller informs the application controller as to the outcome of the wager |
| i | The application controller signals the interactive controller to add additional (or subtract, or add 0) EE to one or more of the EEs of the interactive controller interactive application. This is reflected as function 906 in the figure. |
| j | The interactive controller reconciles the EE(s) of the interactive application. |
| k | The interactive controller signals the application controller as to its updated status, and the application controller signals the interactive controller to add additional (or subtract, or add) AC to one or more of the AC of the interactive controller interactive application. This is reflected in function 907 in the figure. |
| l | The application controller reconciles the AC(s) of the interactive application |

The credit flow according to the process described above, can be illustrated by the following embodiment in a first person shooter game, such as Call of Duty® again using the same alternative application resource interleaved wagering system process:

A the user selects a machine gun to use in the alternative application resource interleaved wagering system. The user fires a burst at an opponent.
{the user performs an action or makes a decision through the alternative application resource interleaved wagering system UI}

B the interactive controller signals the application controller of the user's choice of weapon, that a burst of fire was fired, and the outcome of whether the user hit the opponent with the burst of fire.
{the interactive controller signals the application controller of the user decision or action taken}

C the application controller processes the information in b above, and signals the interactive controller to consume 3 bullets (EE) with each pull of the trigger.
{the application controller signals the interactive controller as to the amount of EE that will be consumed by the user action or decision. This signaling configures function 990 to control the EE consumption, decay or addition}

D the interactive controller interactive application consumes 3 bullets (EE) since the trigger was pulled.
{the interactive controller consumes the amount of EE designated by the application controller to couple to the user action}

E the application controller signals the wager controller that 3 credits of RC are to be wagered to match the 3 bullets (EE) consumed, on a particular pay table (Table Ln-RC) as a function how much damage the user inflicted on his/her opponent.
{the application controller signals the wager controller as to the profile of the wager proposition associated with the particular action, and triggers the wager}

F the wager controller consumes the 3 credits for the wager and executes the specified wager
{the wager controller consumes RC for the wager and executes the wager}

G the wager controller determines that the user hits a jackpot of 6 credits, and returns these 6 credits of RC to the credit meter.
{the wager controller returns RC depending on the outcome of the wager}

H the wager controller informs the application controller that 3 credits of RC net, were won
{the wager controller informs the application controller as to the outcome of the wager}

I the application controller signals the interactive controller to add 3 bullets (EE) to the user's ammo clip
{The application controller signals the interactive controller to add additional (or subtract, or add 0) EE to one or more of the EEs of the interactive controller interactive application. This is reflected as function 990 in the figure}

J the interactive controller adds back 3 bullets (EE) to the user's ammo clip in the interactive application. This may take place by directly adding them to the clip, or may happen in the context of the interactive application, such as the user finding extra ammo on the ground or in an old abandoned ammo dump.
{The interactive controller reconciles the EE(s) of the interactive application}

K The application controller logs the new user score (AC) in the alternative application resource interleaved wagering system (as a function of the successful hit on the opponent) based on interactive controller signaling, and signals the interactive controller to add 2 extra points to their score since a jackpot was won.
{The interactive controller signals the application controller as to its updated status, and the application controller signals the interactive controller to add additional (or subtract, or add 0) AC to one or more of the AC of the interactive controller interactive application. This is reflected in function 991 in the figure}

L the application controller adds 10 points to the user's score (AC) given the success of the hit which in this embodiment is worth 8 points, plus the 2 extra points requested by application controller.
{The interactive controller reconciles the AC(s) of the interactive application.}

Note that the foregoing embodiments are intended to provide an illustration of how credits flow in an alternative application resource interleaved wagering system, but are not intended to be exhaustive, and only list only one of numerous possibilities of how an alternative application resource interleaved wagering system may be configured to manage its fundamental credits.

There is nothing in the alternative application resource interleaved wagering system of FIG. 9 which would preclude the operation of the alternative application resource interleaved wagering system with virtual currency versus using RC. Virtual currency can be thought of as a form of alternate currency, which can be acquired, purchased or transferred, in unit or in bulk, by/to a user, but does not necessarily directly correlate to RC or real currency. In a particular embodiment, there is a virtual currency called "Triax Jacks", 1000 units of which are given to a user by an operator of an alternative application resource interleaved wagering system, with additional blocks of 1000 units being available for purchase for $5 USD each block. Triax Jacks could be redeemed for various prizes, or could never be redeemed but simply used and traded purely for entertainment value by users. It would be completely consistent with the architecture of the alternative application resource interleaved wagering system that Triax Jacks would be wagered in place of RC, such that the alternative application resource interleaved wagering system could be played for free, or with played with operator sponsored Triax Jacks.

Figure 10:
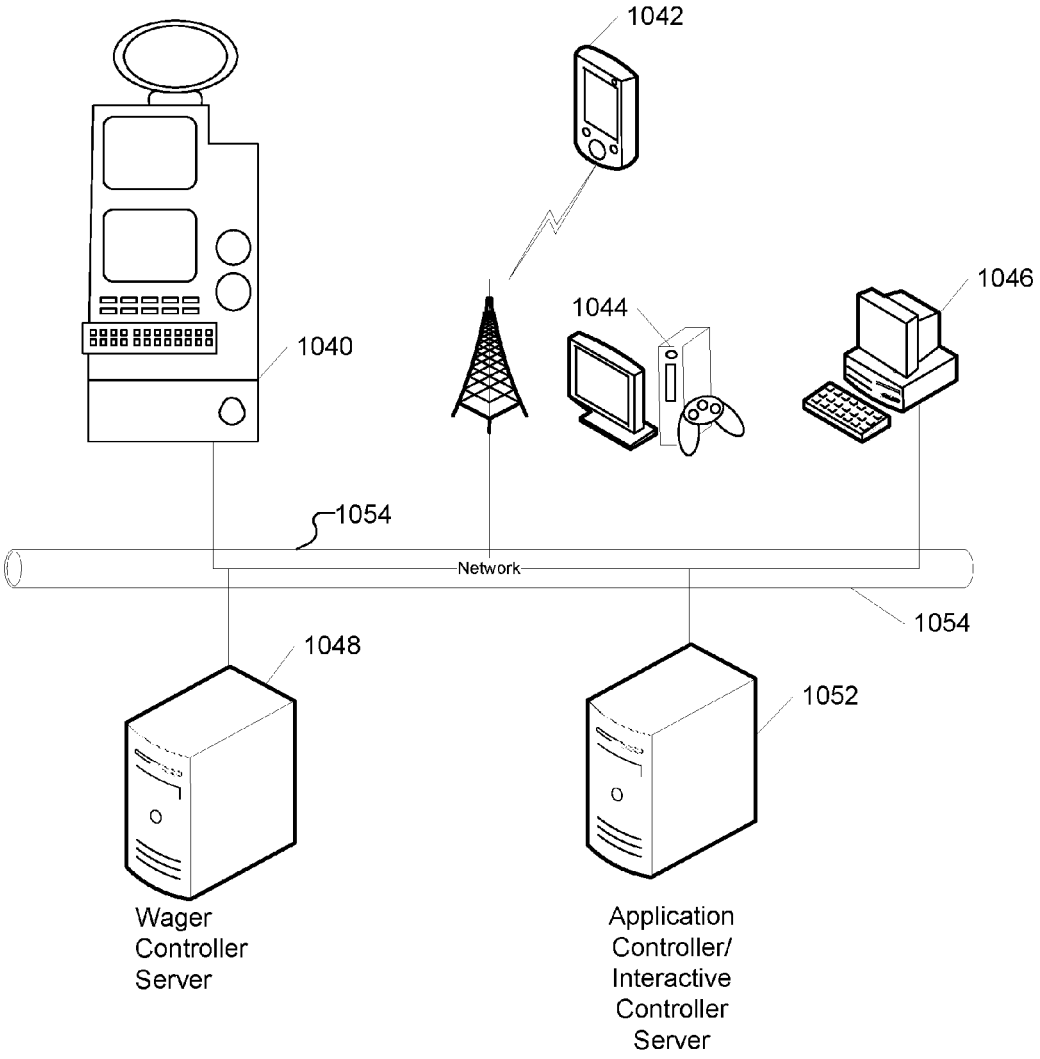
FIG. 10 illustrates an embodiment of a distributed alternative application resource interleaved wagering system in accordance with embodiments of the invention.

FIG. 10 is an illustration of an additional networked alternative application resource interleaved wagering systems in accordance with embodiments of the invention. As illustrated, one or more end devices of networked alternative application resource interleaved wagering systems, such as an electronic gaming machine 1040, a mobile device 1042, a gaming console 1044, and a personal computer 1046 are connected with an wager controller server 1048 and an application controller/interactive controller server 1052 over a network 1054, such as a LAN or a WAN. In these embodiments, the processes of a display and user interface of an interactive controller as described herein are executed on the individual end devices 1040, 1042, 1044 and 1046 while the processes of the wager controller as described herein are executed by the wager controller server 1048, the processes of the application controller and interactive controller, excluding the display and user interfaces of an interactive controller are executed as described herein by the application controller/interactive controller server 1052.

Figure 11:
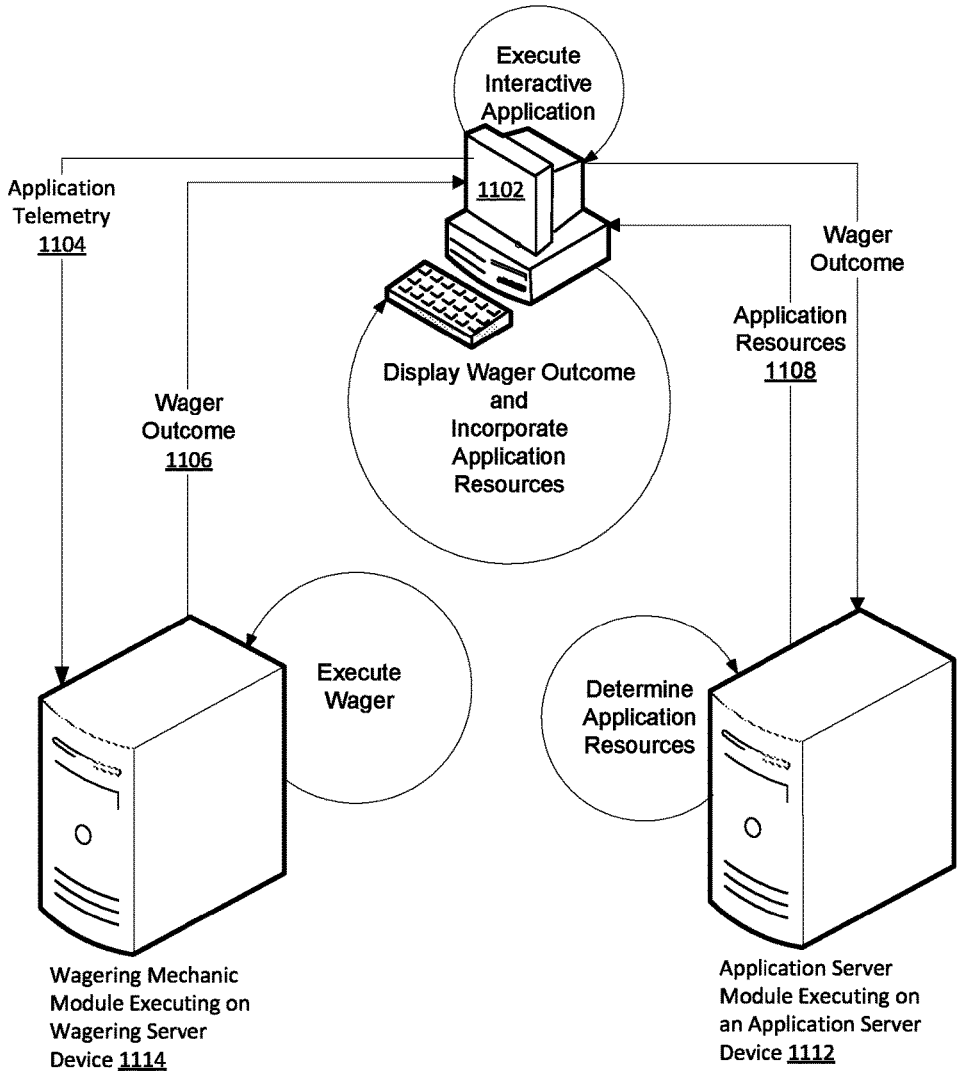
FIG. 11 illustrates an additional networked alternative application resource interleaved wagering systems in accordance with embodiments of the invention.
Figure 12:
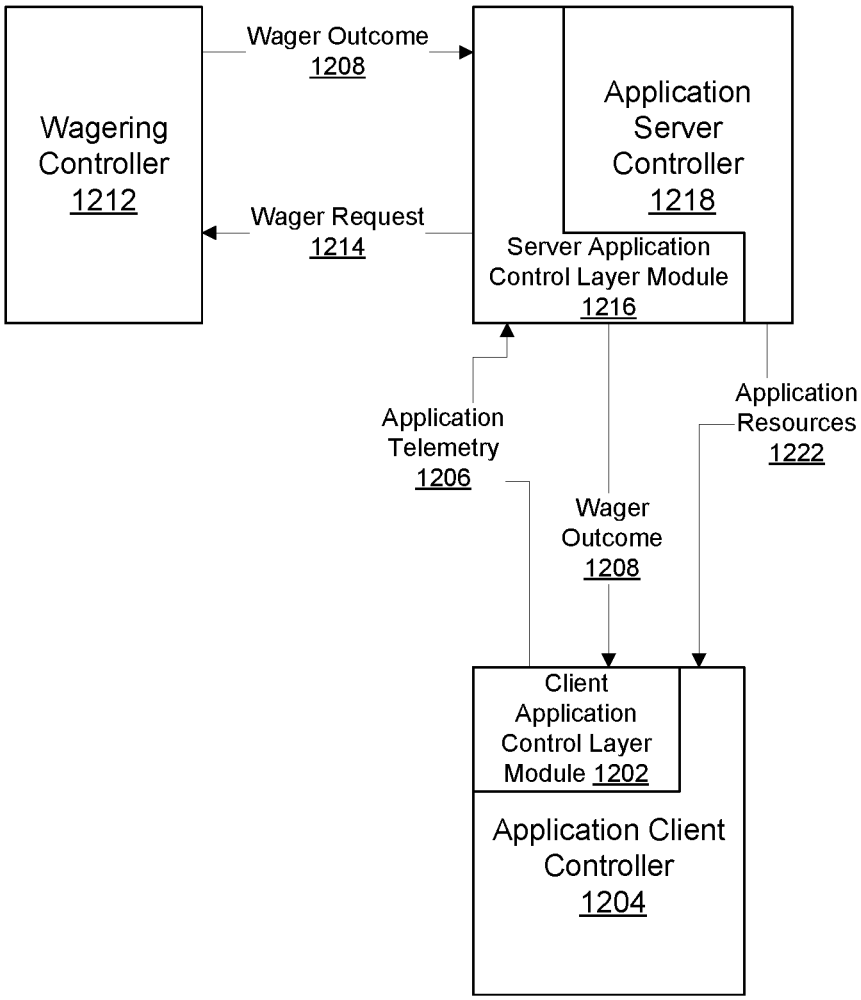
FIG. 12 illustrates an additional networked alternative application resource interleaved wagering systems in accordance with embodiments of the invention.

FIGS. 11 and 12 illustrate additional networked alternative application resource interleaved wagering systems in accordance with embodiments of the invention. In such embodiments, interactive application client devices are controlled to initiate wager requests to wagering mechanic modules and to receive interactive application resources from interactive application server modules, based on wager outcomes generated by wagering mechanic modules in response to wager requests.

FIG. 11 illustrates an exemplary system and sequence of operations of an alternative application resource interleaved wagering systems in accordance with embodiments of the invention. In this embodiment, interactive application client devices are controlled to provide wagering mechanic modules with wager requests, receive wager outcomes from wagering mechanic modules, and provide wager outcomes to interactive application server modules.

As illustrated in FIG. 11, the system includes an interactive application client module executing on an interactive application client device 1102. The interactive application client module executing on the interactive application client device is responsible for the display and user interface of the interactive application, providing application telemetry 1104, receiving wager outcomes 1106, displaying wager outcomes, providing wager outcomes to another device, receiving interactive application resources 1108 and incorporating interactive application resources for the interactive application. In various embodiments, the interactive application client device 1102 may be any end network device such as but not limited to a mobile device, a gaming console, a personal computer or an electronic gaming machine. In some embodiments, the interactive application client device 1102 may include processing and sensing capable of processing global positioning data (GPS) in order to determine a geographical location of the device; such functionality is herein referred to as a GPS receiver.

The system further includes an interactive application server module executing on an interactive application server device (e.g., application controller/interactive controller server) 1112. The interactive application server module is responsible for receiving wager outcomes 1106 from interactive application client device 1102, determining interactive application resources and providing interactive application resources 1108 to the interactive application client device. In some embodiments, the interactive application resources 1108 can include but are not limited to, enabling elements, reserve enabling elements, actionable elements, and common enabling elements. Enabling elements, for example, may include elements consumed by, trade in, operated upon or used to enable the interactive application.

A wagering mechanic module executing on a wagering server device (e.g., wager controller server) is illustrated as 1114. The wagering mechanic module is responsible for receiving application telemetry 1104 from interactive application client device 1102, executing wagers, and providing wager outcomes 1106 to the interactive application client device.

In this embodiment, the interactive application client module is commutatively coupled (e.g., in a LAN, WAN environment using particular UDP/TDP ports and/or networking interfaces such as Gigabyte Ethernet) to both the interactive application server module and the wagering mechanic module.

In accordance with further embodiments of the invention, the interactive application client device 1102 may be external to the wagering server device 1114 and the interactive application server device 1112. In an alternative embodiment, the interactive application client device 1102, the wagering server device 1114 and the interactive application server device 1112, may be "virtualized" (implemented on a Virtual Machine using third party software such as but not limited to from VMWare, Oracle, Citrix etc.) to appear as separate devices on a single physical device.

In operation, the interactive application client module executes an interactive application on interactive application client device 1102. In some embodiments, the interactive application client module may initiate a wager request based on application telemetry 1104. The application telemetry 1104 may relate to an event occurring within the interactive controller. For example, the event can include, but is not limited to, an indication of the accumulation of an enabling element, the transpiring of a game meter tick, a decision made by a user of an interactive application directing a resource within the interactive, an interactive application outcome of a decision made by the user directing a resource within the interactive application, and/or an interactive application action of a user's resource within the interactive application.

The interactive application client module communicates the application telemetry 1104 to the wagering mechanic module executing on wagering server device (wager controller server) 1114. The wagering mechanic module receives the application telemetry from the interactive application client module. The wagering mechanic module scans the application telemetry to determine a wager request.

The wagering mechanic module determines a wager outcome 1106 based on the wager request. The wagering mechanic module generates wager outcome data based on the wager outcome and communicates the wager outcome data 1106 to the interactive application client device 1102, such that the interactive application client module interactive controller receives the wager outcome.

The interactive application client module receives, from the wagering mechanic module, the wager outcome data 1106. In some embodiments, the interactive application client module 1102 updates the display of the interactive application to account for the wager outcome 1106. The interactive application client device 1102 scans the wager outcome data to determine the wager outcome. The interactive application client module generates wager outcome instructions based on the wager outcome. The interactive application client module instructs the interactive application server module executing on an interactive application server device (application controller/interactive controller Server) 1112 by communicating the wager outcome instructions to the interactive application server module.

The interactive application server module receives, from the interactive application client module, the wager outcome instructions. The interactive application server module scans the wager outcome instructions to determine interactive application resource(s) to be provided to the interactive application client module interactive controller. The interactive application server device (application controller/interactive controller server) 1112 communicates the determined interactive application resource(s) 1108 to the interactive application client module interactive controller.

The interactive application client module receives, from the interactive application server module, the application resource(s) 1108. The interactive application client module interactive controller may update the display to account for the interactive application resource(s) 1108 and integrate the interactive application resource(s) into the interactive application client module interactive controller. In some embodiments, the interactive application resource(s) 1108 may be consumed, traded in or acted upon to enable the interactive application through the interactive application client module interactive controller 1102.

FIG. 12 illustrates an exemplary system and sequence of operations of an alternative application resource interleaved wagering systems in accordance with embodiments of the invention. In this embodiment, client interactive application control layer modules of interactive application client devices initiate wager requests by providing application telemetry to server interactive application control layer modules, which generate wager requests based on the application telemetry. Further, interactive application client modules of interactive application client devices receive interactive application resources from interactive application server modules based on wager outcomes provided by wagering mechanic modules.

As illustrated in FIG. 12, the system includes a client interactive application control layer module 1202 executing within an interactive application client controller 1204. In some embodiments, the client application control layer module 1202 may be implemented on an interactive application client device (e.g., 1102). Client interactive application control layer module 1202 is responsible for providing application telemetry 1206 and receiving wager outcomes 1208.

In some embodiments, the wager outcome 1208 to be received by the client interactive application control layer module 1202 may be encrypted using a private encryption key. In such embodiments, in receiving the encrypted wager outcome, a public key may also be received by the client interactive application control layer module 1202 such that the encrypted wager outcome may be decrypted by the entertainment client device using the provided public-key. The interactive application client module 1204 is further responsible for receiving interactive application resources 1222.

The system further includes a wagering controller 1212. In some embodiments, the wagering controller 1212 may be implemented on wagering server devices (e.g., wager controller Server 1114). The wagering controller 1212 is responsible for receiving wager requests 1214, determining wager outcomes and providing instructions that control client devices such as, but not limited to, wager outcomes 1208. In some embodiments, the wagering controller 1212 may encrypt the wager outcome 1208 using a private encryption key of the wagering mechanic module. In such embodiments, the wagering controller 1212 provides recipients of encrypted wager outcome with a public key for decrypting the encrypted wager outcome 1208. In some embodiments, the private key may originate from the wagering controller 1212 or it may originate from a separate source (e.g., Verisign) and be simply stored on the wagering controller.

The system further includes a server interactive application control layer module 1216 executing within an interactive application server controller 1218. In some embodiments, the interactive application server controller 1218 may be implemented on an interactive application server device (e.g., application controller/interactive controller server 1114). The server interactive application control layer module 1216 is responsible for receiving application telemetry 1206, initiating wager requests 1214, receiving wager outcomes 1208, receiving instructions, providing wager outcomes and establishing communication channels to client interactive application control layer module 1202 and wagering controller 1212.

In some embodiments, the server interactive application control layer module 1216 establishes an encrypted communication channel to wagering controller 1212 and an unencrypted communication channel to client interactive application control layer module 1202. The interactive application server controller is responsible for receiving wager outcomes and providing interactive application resources. In some embodiments, the wagering controller 1212 may be included in the wagering mechanic server device (e.g., 1114), the interactive application server controller 1218 and the server interactive application control layer module 1216 may be included in the interactive application server device (e.g., 1112) such that the interactive application client device is external to the wagering mechanic server device and the interactive application server device and communicatively coupled to the interactive application server device. In this embodiment, the interactive application server controller 1218 is communicatively coupled to the interactive application client controller 1204 and the wagering controller 1212.

In operation, application telemetry 1206 is generated by the client interactive application control layer module 1202. The application telemetry 1206 provided may be related to an event occurring in the interactive application. The event can include but is not limited to, an indication of the accumulation of an enabling element, the transpiring of a meter tick, a decision made by a user directing a resource within an interactive application, an interactive application outcome of a decision made by the user directing a resource within the interactive application, or an interactive application action of a user's resource within the interactive application.

The client interactive application control layer module 1202 communicates the application telemetry 1206 to the interactive application server controller 1218 and the server interactive application control layer module 1216 receives the application telemetry. The server interactive application control layer module 1216 scans the application telemetry 1206, and based on the application telemetry 1206, the server interactive application control layer module 1216 initiates a wager request 1214. The server interactive application control layer module 1216 generates wager request instructions and instructs the wagering controller 1212 by communicating the wager request instructions to the wagering controller 1212.

The wagering controller 1212 receives the wager request instructions 1214. The wagering controller 1212 scans the wager request instructions 1214 to determine the wager request. The wagering controller 1212 determines a wager outcome 1208 based on the wager request. The wagering controller 1212 then communicates wager outcome data 1208 to the interactive application server controller 1218 via the server interactive application control layer module 1216.

In some embodiments, the server interactive application control layer module 1216 is controlled to establish a communications channel between the wagering controller 1212 and the interactive application server controller 1218 for the purposes of providing the wager outcome 1208 from the wagering controller 1212 to the interactive application server controller. In this embodiment, the wager outcome 1208 from the wagering controller 1212 is transmitted to the interactive application server controller 1218 such that, the interactive application server controller 1218 determines interactive application resource(s) 1222 to be provided based on the received wager outcome.

The server application control layer module 1216 receives, from the wagering controller 1212, the wager outcome data 1208. The server interactive application control layer module 1216 generates wager outcome instructions based on the wager outcome and provides the wager outcome instructions to the client interactive application control layer module 1202. The server interactive application control layer module 1216 controls the interactive application client device to receive wager outcomes 1208 via the client interactive application control layer module 1202. In some embodiments, the server interactive application control layer module 1216 is controlled to establish an encrypted communications channel from the wagering controller 1212 to the client interactive application control layer module 1202 for the purposes of providing the wager outcome 1208 from the wagering controller 1212 to the client interactive application control layer module 1202. In some embodiments, the wager outcome 1208 is provided in the form of an image or picture. For example, a picture of the word WINNER! may be formed from the wager outcome 1208. In such embodiments, the interactive application client device is controlled to display the image or picture.

The interactive application client controller 1204 is controlled to receive the determined interactive application resource(s) 1222 from the interactive application server controller 1218. The application server controller 1218 determines the interactive application resources 1222 based on the wager outcome 1208. The application server controller 1218 generates application resource instructions based on the determined application resources and instructs the application client controller 1204 by communicating the application resource instructions to the application client controller 1204. In some embodiments, the interactive application resource 1222 may be consumed, traded in or acted upon to enable the interactive application.

Figure 13:
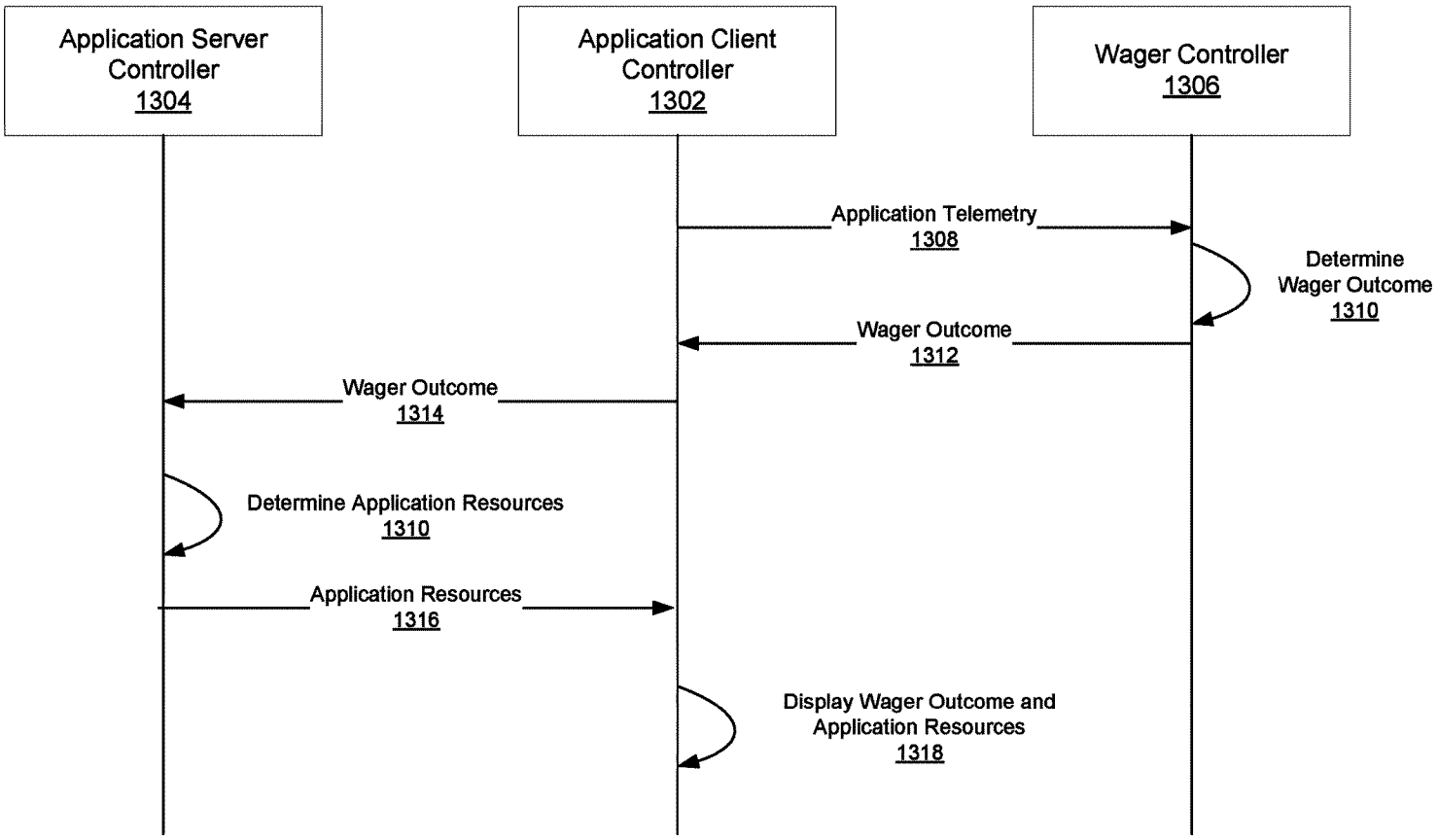
FIG. 13 is a sequence diagram of a networked alternative application resource interleaved wagering system in accordance with embodiments of the invention.

FIG. 13 is a sequence diagram of a networked alternative application resource interleaved wagering system in accordance with embodiments of the invention.

In some embodiments, the system includes an application client controller 1302, an application server controller 1304, and a wager controller 1306. In some embodiments, the application client controller includes a client application control layer module. In some embodiments, the application server controller includes a server application control layer module. In some embodiments, the application client controller 1302 provides an interactive application. In some embodiments, the interactive application is an interactive game. In some embodiments, the interactive game is a skill based game. In some embodiments, the interactive game is a chance based game.

The application client controller 1302 communicates, to the wager controller 1306, application telemetry (1308). In some embodiments, the application client controller 1302 communicates the application telemetry to the wager controller 1306 via the client application control layer module. The wager controller 1306 receives, from the application client controller 1302, the application telemetry (1308).

The wager controller 1306 scans the application telemetry to determine a wager request. The wager controller 1306 determines a wager outcome based on the wager request (1310). The wager controller 1306 communicates, to the application client controller 1302, wager outcome data based on the wager outcome (1312). The application client controller 1302 receives, from the wager controller 1306, the wager outcome data (1312). In some embodiments, the application client controller 1302 receives the wager outcome data via the client application control layer module.

The application client controller 1302 scans the wager outcome data to determine the wager outcome. The application client controller 1302 generates wager outcome instructions based on the wager outcome. The application client controller 1302 instructs the application server controller 1304 by communicating the wager outcome instructions (1314). In some embodiments, the application client controller 1302 communicates the wager outcome instructions from the client application control layer module to the server application control layer module of the application server controller 1304.

The application server controller 1304 receives, from the application client controller 1302 the wager outcome instructions (1314). The application server controller 1304 scans the wager outcome instructions to determine the wager outcome. The application server controller 1304 determines application resources to award the application client controller 1302 based on the wager outcome (1310). The application server controller 1304 communicates application resource data to the application client controller 1302 (1316). In some embodiments, the application server controller 1304 communicates the application resource data via the server application control layer module to the client application control layer module of the application client controller 1302.

The application client controller 1302 receives, from the application server controller 1304, the application resource data (1316). The application client controller 1302 scans the application resource data to determine the application resource awarded to the user based on the wager outcome. The application client controller 1302 displays the wager outcome and the application resources awarded (1318).

While the above description may include many specific embodiments of the invention, these should not be construed as limitations on the scope of the invention, but rather as an example of one embodiment thereof. It is therefore to be understood that the present invention can be practiced otherwise than specifically described, without departing from the scope and spirit of the present invention. Thus, embodiments of the present invention should be considered in all respects as illustrative and not restrictive.

What is claimed:

1. An electronic gaming machine, comprising:

a wager controller constructed to:

receive, from an application client controller, application telemetry;

scan the application telemetry to determine a wager request;

determine an encrypted wager outcome based on the wager request; and communicate, to the application client controller, the encrypted wager outcome that is encrypted with a private encryption key of the wager controller;

provide, to the application client controller, a public key for decrypting the encrypted wager outcome; and an application server controller constructed to:

receive, from the application client controller, decrypted wager outcome instructions;

determine application resources to award the application client controller based on the decrypted wager outcome; and communicate application resource data to the application client controller, the application resource data based on the determined application resources; and the application client controller operatively connecting the application server controller and the wager controller, the application client controller constructed to:

communicate, to the wager controller, the application telemetry, wherein the application telemetry is associated with an interactive application provided by the application client controller;

receive, from the wager controller, the encrypted wager outcome;

decrypt the encrypted wager outcome by using the public key;

generate the decrypted wager outcome instructions based on the encrypted wager outcome;

instruct the application server controller by communicating the decrypted wager outcome instructions;

receive, from the application server controller, the application resource data;

scan the application resource data to determine the application resources awarded based on the decrypted wager outcome; and display the decrypted wager outcome and the application resources awarded.

2. The electronic gaming machine of claim 1, wherein the application client controller and the application server controller are constructed from the same device, and wherein the application client controller is operatively connected to the wager controller using a communication link.

3. The electronic gaming machine of claim 1, wherein the wager controller and the application client controller are constructed from the same device, and wherein the application client controller is operatively connected to the application server controller using a communication link.

4. The electronic gaming machine of claim 1, wherein the wagering controller is included in a wagering server device, the application server controller is included in an application server device, and the application client controller is included in an application client device, the application client device being external to the wagering server device and the application server device, and wherein the application client device is communicatively coupled to the wagering server device and the application server device.

5. The electronic gaming machine of claim 1, wherein the application client controller comprises a client application control layer module, and the application client controller is operatively connected to the application client controller and the wager controller via the client application control layer module, and wherein the application server controller comprises a server application control layer module, and the application server controller is operatively connected to the application client controller via the server application control layer module.

6. The electronic gaming machine of claim 5, wherein the wagering controller is included in a wagering server device, the application server controller and the server application control layer module are included in an application server device, and the application client controller and the client application control layer module are included in an application client device, wherein the application client device is external to the wagering server device and the application server device, and wherein the application client device is communicatively coupled to the interactive application server device and the wagering server device.

7. The electronic gaming machine of claim 5, wherein the server application control layer module is constructed to provide communication between the wagering controller and the application server controller by using a first communication channel, and wherein the server application control layer module is constructed to provide communication between the wagering controller and the application client device by using a second communication channel, the second communication channel being an encrypted communication channel.

8. An electronic gaming machine, comprising:

an application server controller constructed to:

receive, from the application client controller, decrypted wager outcome instructions;

determine application resources to award the application client controller based on the decrypted wager outcome; and communicate application resource data to the application client controller, the application resource data based on the determined application resources; and the application client controller operatively connecting the application server controller and a wager controller, the application client controller constructed to:

communicate, to the wager controller, application telemetry, wherein the application telemetry is associated with an interactive application provided by the application client controller;

receive, from the wager controller, encrypted wager outcome data;

receive, from the wager controller, a public key;

decrypt the encrypted wager outcome by using the public key;

generate the decrypted wager outcome instructions based on the encrypted wager outcome;

instruct the application server controller by communicating the decrypted wager outcome instructions;

receive, from the application server controller, the application resource data;

scan the application resource data to determine the application resources awarded based on the decrypted wager outcome; and display the decrypted wager outcome and the application resources awarded.

9. The electronic gaming machine of claim 8, wherein the wagering controller is included in a wagering server device, the application server controller is included in an application server device, and the application client controller is included in an application client device, the application client device being external to the wagering server device and the application server device, and wherein the application client device is communicatively coupled to the wagering server device and the application server device.

10. The electronic gaming machine of claim 8, wherein the application client controller comprises a client application control layer module, and the application client controller is operatively connected to the application client controller and the wager controller via the client application control layer module, and wherein the application server controller comprises a server application control layer module, and the application server controller is operatively connected to the application client controller via the server application control layer module.

11. The electronic gaming machine of claim 10, wherein the wagering controller is included in a wagering server device, the application server controller and the server application control layer module are included in an application server device, and the application client controller and the client application control layer module are included in an application client device, wherein the application client device is external to the wagering server device and the application server device, and wherein the application client device is communicatively coupled to the interactive application server device and the wagering server device.

12. The electronic gaming machine of claim 10, wherein the server application control layer module is constructed to provide communication between the wagering controller and the application server controller by using a first communication channel, and wherein the server application control layer module is constructed to provide communication between the wagering controller and the application client device by using a second communication channel, the second communication channel being an encrypted communication channel.

13. An electronic gaming machine, comprising:

a wager controller constructed to:

receive, from an application client controller, application telemetry;

scan the application telemetry to determine a wager request;

determine an encrypted wager outcome based on the wager request; and communicate, to the application client controller, the encrypted wager outcome that is encrypted with a private encryption key of the wager controller;

provide, to the application client controller, a public key for decrypting the encrypted wager outcome; and the application client controller operatively connecting an application server controller and the wager controller, the application client controller constructed to:

communicate, to the wager controller, the application telemetry, wherein the application telemetry is associated with an interactive application provided by the application client controller;

receive, from the wager controller, the encrypted wager outcome data;

decrypt the encrypted wager outcome by using the public key;

generate the decrypted wager outcome instructions based on the encrypted wager outcome;

instruct the application server controller by communicating the decrypted wager outcome instructions;

receive, from the application server controller, the application resource data;

scan the application resource data to determine the application resources awarded based on the decrypted wager outcome; and display the decrypted wager outcome and the application resources awarded.

14. The electronic gaming machine of claim 13, wherein the wagering controller is included in a wagering server device, the application server controller is included in an application server device, and the application client controller is included in an application client device, the application client device being external to the wagering server device and the application server device, and wherein the application client device is communicatively coupled to the wagering server device and the application server device.

15. The electronic gaming machine of claim 13, wherein the application client controller comprises a client application control layer module, and the application client controller is operatively connected to the application client controller and the wager controller via the client application control layer module, and wherein the application server controller comprises a server application control layer module, and the application server controller is operatively connected to the application client controller via the server application control layer module.

16. The electronic gaming machine of claim 15, wherein the wagering controller is included in a wagering server device, the application server controller and the server application control layer module are included in an application server device, and the application client controller and the client application control layer module are included in an application client device, wherein the application client device is external to the wagering server device and the application server device, and wherein the application client device is communicatively coupled to the interactive application server device and the wagering server device.

17. The electronic gaming machine of claim 15, wherein the server application control layer module is constructed to provide communication between the wagering controller and the application server controller by using a first communication channel, and wherein the server application control layer module is constructed to provide communication between the wagering controller and the application client device by using a second communication channel, the second communication channel being an encrypted communication channel.

* * * * *